US012742564B2

(12) United States Patent
Aschow et al.

(10) Patent No.: US 12,742,564 B2
(45) Date of Patent: Sep. 22, 2026

(54) SYSTEMS AND METHODS FOR REFRIGERANT UNIT LIFE CYCLE MANAGEMENT

(71) Applicant: Effecterra, Inc., Reno, NV (US)

(72) Inventors: Evan Aschow, Fair Oaks, CA (US); Michael May, Reno, NV (US)

(73) Assignee: EFFECTERRA, INC., Reno, NV (US)

( * ) Notice: Subject to any disclaimer, the term of this patent is extended or adjusted under 35 U.S.C. 154(b) by 722 days.

(21) Appl. No.: 17/952,893

(22) Filed: Sep. 26, 2022

(65) Prior Publication Data

US 2024/0102683 A1 Mar. 28, 2024

(51) Int. Cl.
*F24F 11/64* (2018.01)
*F24F 11/36* (2018.01)
(Continued)

(52) U.S. Cl.
CPC ..... *F24F 11/64* (2018.01); *F24F 11/36* (2018.01); *F24F 11/52* (2018.01); *F25B 45/00* (2013.01);
(Continued)

(58) Field of Classification Search
CPC .. F24F 11/64; F24F 11/36; F24F 11/52; F25B 45/00; F25B 2345/001; F25B 2345/002
See application file for complete search history.

(56) References Cited

U.S. PATENT DOCUMENTS 3,537,312 A 11/1970 Moore
5,157,936 A * 10/1992 Wall ..... F25B 45/00 62/77
(Continued)

FOREIGN PATENT DOCUMENTS

JP 2020-186841 A 11/2020
KR 100667976 B1 * 1/2007 ..... F25B 45/00
KR 10-2021-0005511 A 1/2021

OTHER PUBLICATIONS

International Search Report and Written Opinion on International Patent Application No. PCT/US2023/032645 dated Jan. 16, 2024 (12 pages).

*Primary Examiner* — Kenneth M Lo
*Assistant Examiner* — Zachary Andrew Cain
(74) *Attorney, Agent, or Firm* — Foley & Lardner LLP

(57) ABSTRACT

A method includes determining, based on a signal from a sensor of a service tool that couples with a service port of the HVAC/Refrigeration system to add refrigerant to the HVAC/Refrigeration system or remove refrigerant from the HVAC/Refrigeration system, an amount of refrigerant added to the HVAC/Refrigeration system or an amount of refrigerant removed from the HVAC/Refrigeration system. The method includes determining a current refrigerant level in the HVAC/Refrigeration system. The method also includes performance monitoring for a fleet of units, and predicting an indication of a leak at the HVAC/Refrigeration system. The method includes building or using a database along with artificial intelligence (AI) or machine learning (ML) to predict leaks. The method includes operating a display to provide at least one of the amount of refrigerant added, the amount or refrigerant removed, or the current refrigerant level of the HVAC/Refrigeration system to a user.

21 Claims, 8 Drawing Sheets

(51) Int. Cl.
*F24F 11/52* (2018.01)
*F25B 45/00* (2006.01)

(52) U.S. Cl.
CPC ... *F25B 2345/001* (2013.01); *F25B 2345/002* (2013.01)

(56) References Cited

U.S. PATENT DOCUMENTS 9,285,802 B2 3/2016 Arensmeier
9,703,287 B2 7/2017 Arensmeier
9,995,502 B1 6/2018 Reeder
10,234,854 B2 3/2019 Arensmeier
10,309,677 B2 6/2019 Abiprojo et al.
10,655,874 B1 5/2020 Reeder
10,884,403 B2 1/2021 Arensmeier
10,948,209 B2 3/2021 Song et al.
2004/0055317 A1 3/2004 Nomura et al.
2004/0123622 A1* 7/2004 Yuzawa ..... F25B 45/00 62/474
2005/0240312 A1* 10/2005 Terry ..... G05B 15/02 700/276
2007/0277537 A1 12/2007 Parthasarathy et al.
2010/0180617 A1 7/2010 Martin
2011/0137853 A1* 6/2011 Mackay ..... G06Q 10/06 706/57
2011/0160918 A1* 6/2011 McMasters ..... F25B 45/00 700/282
2017/0011318 A1* 1/2017 Vigano ..... G06N 20/00
2017/0314800 A1 11/2017 Bengea et al.
2019/0170603 A1* 6/2019 Gupte ..... F25B 49/005
2021/0262689 A1 8/2021 Shinde et al.
2022/0010996 A1 1/2022 Carrieri
2022/0049883 A1* 2/2022 Alfano ..... F25B 45/00
2022/0146136 A1 5/2022 Ba et al.
2022/0221206 A1* 7/2022 Yagi ..... G06Q 10/20
2023/0145448 A1* 5/2023 Huber ..... G05B 23/024 700/275
2024/0035695 A1* 2/2024 Mohammad ..... F24F 11/89

* cited by examiner

1400

| Manufacturer | Model No. | Serial No. | Manufactured Date | Refrig. Type | Refrig. Level | Refrig. Capacity | Factory Refrig. Chrge. |
|---|---|---|---|---|---|---|---|
| Company X | Model A | 581M1Z | 4-4-2020 | R-410A | 95% | 400 L | 6-2-2020 |
| Company Y | Model 1 | AI1j6Paa | 1-2-2018 | R-410A | 95% | 600 L | 2-1-2018 |
| Company X | Model B | 245Q7L | 7-10-2017 | R-410A | 97% | 600 L | 7-25-2017 |
| ... | ... | ... | ... | ... | ... | ... | ... |
| Company Z | Model II | 5138468 | 10-8-2019 | R-134a | 96% | 500 L | 1-15-2020 |

FIG. 8

SYSTEMS AND METHODS FOR REFRIGERANT UNIT LIFE CYCLE MANAGEMENT

BACKGROUND

The present disclosure relates generally to systems and methods for refrigerant life cycle management for an HVAC/Refrigeration unit that uses refrigerants as a working fluid to provide space cooling or heating. More particularly, the present disclosure relates to systems and methods for tracking and managing the refrigerant history of an HVAC/Refrigeration unit over its lifetime.

SUMMARY

One implementation of the present disclosure is a system for tracking refrigerant of a HVAC/Refrigeration system, according to some embodiments. In some embodiments, the system includes a HVAC/Refrigeration system, a service tool, and processing circuitry. In some embodiments, the HVAC/Refrigeration system is configured to circulate a refrigerant to heat or cool a space. In some embodiments, the HVAC/Refrigeration system includes a service port for defining a fluid pathway into or out of an inner volume of a tubular member of the HVAC/Refrigeration system. In some embodiments, the service tool is configured to removably couple with the service port to define a fluid flow path between a reservoir of the service tool and the inner volume of the tubular member of the HVAC/Refrigeration system. In some embodiments, the service tool is configured to add refrigerant to the HVAC/Refrigeration system or remove refrigerant from the HVAC/Refrigeration system. In some embodiments, the service tool includes a sensor configured to generate a signal indicative of an amount of refrigerant added to the HVAC/Refrigeration system or an amount of refrigerant removed from the HVAC/Refrigeration system. In some embodiments, the processing circuitry is configured to obtain the signal from the sensor of the service tool, and determine, based on the signal, at least one of the amount of refrigerant added to the HVAC/Refrigeration system or the amount of refrigerant removed from the HVAC/Refrigeration system. In some embodiments, the processing circuitry is configured to determine, based on at least one of the amount of refrigerant added to the HVAC/Refrigeration system or the amount of refrigerant removed from the HVAC/Refrigeration system, a current refrigerant level in the HVAC/Refrigeration system. In some embodiments, the processing circuitry is configured to store at least one of the amount of refrigerant in the HVAC/Refrigeration system, the amount of refrigerant added to the system, or the amount of refrigerant removed from the system in a database.

In some embodiments, the processing circuitry is configured to obtain, based on a user input, or based on a captured image, a unique identifier of the HVAC/Refrigeration system. In some embodiments, the unique identifier is associated with the amount of refrigerant, the amount of refrigerant added to the HVAC/Refrigeration system, or the amount of refrigerant removed from the HVAC/Refrigeration system and the unique identifier is stored in the database.

In some embodiments, the processing circuitry is configured to obtain, based on a user input, or based on the captured image, a type of refrigerant that is currently in the HVAC/Refrigeration system. In some embodiments, the type of refrigerant is associated with the unique identifier of the HVAC/Refrigeration system and is stored in the database.

In some embodiments, the processing circuitry is configured to determine and store in the database, at least one of an amount of refrigerant added, an amount of refrigerant removed, or a current refrigerant level of multiple different HVAC/Refrigeration systems. In some embodiments, the processing circuitry is further configured to obtain a unique identifier of each of the multiple different HVAC/Refrigeration systems, and store the unique identifier of each of the multiple different HVAC/Refrigeration systems in the database. In some embodiments, the at least one of the amount of refrigerant added, the amount of refrigerant removed, or the current refrigerant level is associated with a unique identifier for an associated HVAC/Refrigeration system.

In some embodiments, the database includes historical data and a corresponding date of at least one of the amount of refrigerant added, the amount of refrigerant removed, or the current refrigerant level of the multiple different HVAC/Refrigeration systems. In some embodiments, the corresponding date indicating a date of a service operation at which the at least one of the amount of refrigerant added, the amount of refrigerant removed, or the current refrigerant level is determined.

In some embodiments, the processing circuitry is further configured to generate a graphical user interface based on data from the database. In some embodiments, the graphical user interface illustrates at least one of the amount of refrigerant added, the amount of refrigerant removed, or the current refrigerant level of the multiple different HVAC/Refrigeration systems, and the unique identifier of each of the multiple different HVAC/Refrigeration systems. In some embodiments, the processing circuitry is further configured to cause a display to operate to provide the graphical user interface to a technician via a smartphone or to provide the graphical user interface to a system manager via a webpage.

In some embodiments, the system further includes a user device including processing circuitry and a camera. In some embodiments, the user device is configured to capture an image of a data plate of the HVAC/Refrigeration system and at least one of the processing circuitry of the user device or processing circuitry of a cloud computing system is configured to perform an image analysis technique to extract inventory information from the image of the data plate.

In some embodiments, the cloud computing system is configured to store the inventory information extracted from the image in the database. In some embodiments, the inventory information includes a manufacturer of the HVAC/Refrigeration system, a model number of the HVAC/Refrigeration system, a serial number of the HVAC/Refrigeration system, a date that the HVAC/Refrigeration system was manufactured, a type of refrigerant of the HVAC/Refrigeration system, and a factory refrigerant charge level or date of the HVAC/Refrigeration system.

In some embodiments, the method includes obtaining subcooling temperature data of the HVAC/Refrigeration system. The method also includes predicting a leakage event and a root cause of the leakage event based on the subcooling temperature data and using machine learning and a root cause database, according to some embodiments. In some embodiments, the method includes operating the display to notify the user regarding the predicted leakage event and the root cause.

Another implementation of the present disclosure is a method for tracking refrigerant of a HVAC/Refrigeration system, according to some embodiments. In some embodiments, the method includes obtaining a signal from a sensor of a service tool. In some embodiments, the service tool is configured to removably couple with a service port of the HVAC/Refrigeration system to define a fluid flow path between a reservoir of the service tool and the inner volume of the tubular member of the HVAC/Refrigeration system. In some embodiments, the service tool is configured to add refrigerant to the HVAC/Refrigeration system or remove refrigerant from the HVAC/Refrigeration system. In some embodiments, the method includes determining, based on the signal, at least one of an amount of refrigerant added to the HVAC/Refrigeration system or an amount of refrigerant removed from the HVAC/Refrigeration system. In some embodiments, the method includes determining, based on at least one of the amount of refrigerant added to the HVAC/Refrigeration system or the amount of refrigerant removed from the HVAC/Refrigeration system, a current refrigerant level in the HVAC/Refrigeration system. In some embodiments, the method includes operating a display to provide at least one of the amount of refrigerant added, the amount or refrigerant removed, or the current refrigerant level of the HVAC/Refrigeration system to a user.

In some embodiments, the method includes storing at least one of the amount of refrigerant in the HVAC/Refrigeration system, the amount of refrigerant added to the system, or the amount of refrigerant removed from the system in a database.

In some embodiments, the method includes obtaining, based on a user input, or based on a captured image, a unique identifier of the HVAC/Refrigeration system. In some embodiments, the unique identifier is associated with the amount of refrigerant, the amount of refrigerant added to the HVAC/Refrigeration system, or the amount of refrigerant removed from the HVAC/Refrigeration system and the unique identifier is stored in the database. In some embodiments, the method includes providing the unique identifier of the HVAC/Refrigeration system to a cloud computing system with the amount of refrigerant added to the HVAC/Refrigeration system and the amount of refrigerant removed from the HVAC/Refrigeration system.

In some embodiments, the method includes obtaining, based on a user input, or based on the captured image, a type of refrigerant that is currently in the HVAC/Refrigeration system. In some embodiments, the type of refrigerant is associated with the unique identifier of the HVAC/Refrigeration system and is stored in the database. In some embodiments, the method includes providing the type of refrigerant to the cloud computing system with the unique identifier, the amount of refrigerant added to the HVAC/Refrigeration system, and the amount of refrigerant removed from the HVAC/Refrigeration system.

In some embodiments, the method includes determining at least one of an amount of refrigerant added, an amount of refrigerant removed, or a current refrigerant level of a plurality of different HVAC/Refrigeration systems. In some embodiments, the method includes obtaining a unique identifier of each of the plurality of different HVAC/Refrigeration systems. In some embodiments, the at least one of the amount of refrigerant added, the amount of refrigerant removed, or the current refrigerant level is associated with the unique identifier for an associated one of the plurality of different HVAC/Refrigeration systems. In some embodiments, the method includes storing at least one of the amount of refrigerant added, the amount of refrigerant removed, or the current refrigerant level of the plurality of different HVAC/Refrigeration systems in a database with a plurality of unique identifiers.

In some embodiments, the database includes historical data and a corresponding date of at least one of the amount of refrigerant added, the amount of refrigerant removed, or the current refrigerant level of the plurality of different HVAC/Refrigeration systems. In some embodiments, the corresponding date indicates a date of a service operation at which the at least one of the amount of refrigerant added, the amount of refrigerant removed, or the current refrigerant level is determined.

In some embodiments, the method includes generating a graphical user interface based on data from the database, the graphical user interface illustrating at least one of the amount of refrigerant added, the amount of refrigerant removed, or the current refrigerant level of the plurality of different HVAC/Refrigeration systems, and the unique identifier of each of the plurality of different HVAC/Refrigeration systems. In some embodiments, the method includes operating the display by providing the graphical user interface to a technician via a smartphone or providing the graphical user interface to a system manager via a webpage.

In some embodiments, the method includes capturing an image of a data plate of the HVAC/Refrigeration system using a user device that includes processing circuitry and a camera. In some embodiments, the method includes performing an image analysis technique to extract inventory information of the HVAC/Refrigeration system from the image of the data plate.

In some embodiments, the method includes storing the inventory information extracted from the image in a database. In some embodiments, the inventory information includes a manufacturer of the HVAC/Refrigeration system, a model number of the HVAC/Refrigeration system, a serial number of the HVAC/Refrigeration system, a date that the HVAC/Refrigeration system was manufactured, a type of refrigerant of the HVAC/Refrigeration system, and a factory refrigerant charge level or date of the HVAC/Refrigeration system.

Another implementation of the present disclosure is a system for tracking refrigerant and status of refrigerated display cases, HVAC/Refrigeration units, rooftop units, or heatpump units, according to some embodiments. In some embodiments, the system includes multiple HVAC/refrigerated units, a service tool, and a user device. In some embodiments, each refrigerated unit includes a HVAC/Refrigeration system configured to cool an inner volume of the refrigerated unit. In some embodiments, the service tool is configured to measure an amount of refrigerant added or removed from any of the plurality of refrigerated units during a servicing operation. In some embodiments, the user device is configured to establish communication with a cloud computing system. In some embodiments, the user device is configured to communicate with processing circuitry of the service tool to provide data from the service tool regarding the amount of refrigerant added or removed from any of the refrigerated units. In some embodiments, the cloud computing system is configured to obtain a unique identifier indicating which of the plurality of refrigerated units the data from the user device is associated with. In some embodiments, the cloud computing system is configured to obtain the data from the user device regarding the amount of refrigerant added or removed from a particular one of the plurality of refrigerated units. In some embodiments, the cloud computing system is configured to store the data regarding the amount of refrigerant added or removed from the particular one of the plurality of refrigerated units in a database associated with the unique identifier. In some embodiments, the database includes the data regarding the amount of refrigerant added or removed from the plurality of refrigerated units for each time the servicing operation is performed at the plurality of refrigerated units. In some embodiments, the cloud computing system is configured to operate a display to provide an inventory tracking report illustrating an amount of refrigerant present in the plurality of refrigerated units based on the database.

In some embodiments, at least one of the plurality of refrigerated units are refrigerated display cases. In some embodiments, each of the plurality of refrigerated units includes a unique identifier that is disposed graphically or textually on a surface of the refrigerated unit.

This summary is illustrative only and is not intended to be in any way limiting. Other aspects, inventive features, and advantages of the devices or processes described herein will become apparent in the detailed description set forth herein, taken in conjunction with the accompanying figures, wherein like reference numerals refer to like elements.

BRIEF DESCRIPTION OF THE DRAWINGS

The disclosure will become more fully understood from the following detailed description, taken in conjunction with the accompanying figures, wherein like reference numerals refer to like elements, in which:

FIG. 8 is a table illustrating inventory data of a fleet of HVAC/Refrigeration systems, according to some embodiments.

DETAILED DESCRIPTION

Before turning to the Figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Referring generally to the FIGURES, systems and methods for tracking refrigerant of HVAC/Refrigeration units having a HVAC/Refrigeration system include a service tool that measures an amount of refrigerant added or removed from the HVAC/Refrigeration unit. The service tool may include processing circuitry and can communicate with a controller of the HVAC/Refrigeration system to obtain health data, performance data, etc. The service tool may also communicate with a smartphone that includes a mobile application. The smartphone may be usable by a technician to obtain an image of a data plate of the HVAC/Refrigeration unit or system for proper sorting of any data obtained that is associated with the HVAC/Refrigeration unit. The smartphone may report any of the health data, the performance data, the refrigerant added, removed, or consumed, data, and any of the data of the data plate to a cloud computing system. The cloud computing system can be configured to perform refrigerant tracking, inventory tracking, etc. Outputs of the cloud computing system can be viewed by a system manager or the technician. The systems and methods described herein advantageously facilitate the tracking of different types of refrigerant, inform the system manager regarding any environmental impacts of the HVAC/Refrigeration systems or refrigerants used therein, and also can provide environmental regulation updates to the system manager (e.g., if a particular refrigerant is banned from use) so that the system manager can make appropriate changes to the fleet of HVAC/Refrigeration systems. The systems and methods described herein also have the advantage of being autonomous and automatically measuring refrigerant added, thereby reducing an amount of time it takes the technician to service a HVAC/Refrigeration unit.

Refrigerant Tracking System

Overview

Figure 1:
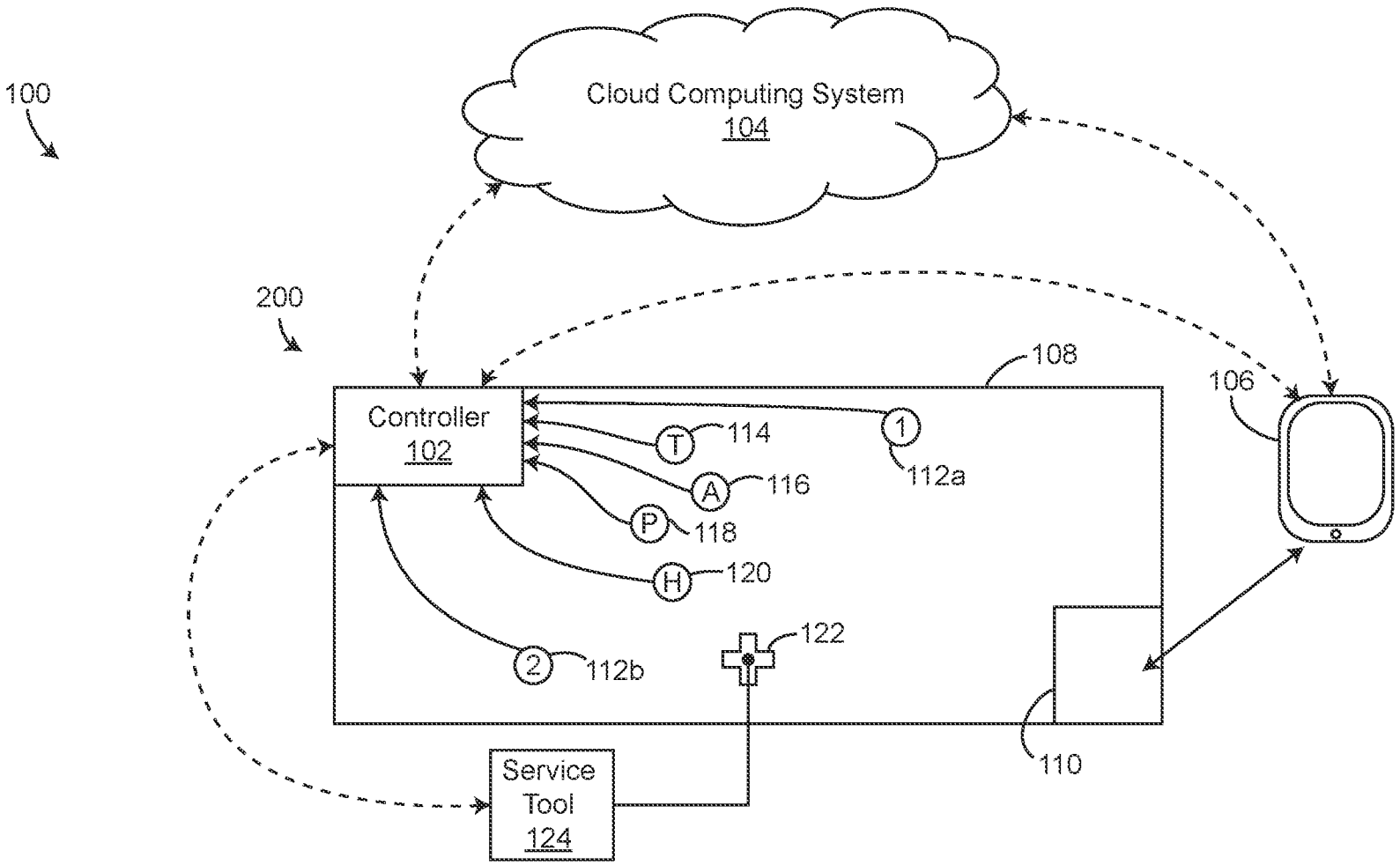
FIG. 1 is a block diagram of a refrigerant tracking system including a service tool and a HVAC/Refrigeration system, according to some embodiments.

Referring to FIG. 1, a refrigerant tracking system 100 is configured to monitor, track, and report amounts of refrigerant consumed over a lifetime or a portion of lifetime of refrigeration equipment. The refrigerant tracking system 100 may work in combination with a service tool 124 to track amounts of refrigerant added or removed from the HVAC/Refrigeration system and to determine amounts of refrigerant consumed by the HVAC/Refrigeration unit over its lifetime, amount of a certain type of refrigerant that has leaked from the HVAC/Refrigeration unit (e.g., to the environment), etc.

Referring still to FIG. 1, the refrigerant tracking system 100 includes a cloud computing system 104, a HVAC/Refrigeration unit 108 (e.g., a critically charged HVAC/Refrigeration system, refrigeration equipment, a refrigerator, a refrigerated display case, a heat pump, a rooftop unit, a stand-alone unit, a freezer, etc.), the service tool 124, and a user device 106. The HVAC/Refrigeration unit 108 includes a controller 102, one or more temperature sensors 114, one or more amperage sensors 116, one or more pressure sensors 118, one or more humidity sensors 120, and one or more leak detectors 112 (shown as leak detector 112*a* and leak detector 112*b*). The controller 102 is configured to obtain any temperature, pressure, amperage, humidity, etc., from the temperature sensors 114, the amperage sensors 116, the pressure sensors 118, or the humidity sensors 120. The controller 102 is also configured to obtain any leak detection from the leak detectors 112. In some embodiments, the temperature, pressure, or humidity sensor data provided to the controller 102 include temperature and humidity of a zone which the HVAC/Refrigeration unit 108 operates to cool. In some embodiments, the temperature or pressure is a temperature or pressure of a refrigerant of the HVAC/Refrigeration unit 108 at any position in a refrigeration loop. In some embodiments, the controller 102 is configured to obtain amperage of any compressor of the HVAC/Refrigeration unit 108.

It should be understood that the terms "HVAC/Refrigeration system" "refrigerated unit" or "HVAC/Refrigeration unit" as used herein may refer to any system or equipment that uses a refrigerant as a working fluid to cool or heat a space. In this way, the HVAC/Refrigeration unit 108 may be or include a heating, ventilation, or air-conditioning (HVAC) system or equipment, a heat pump, a refrigerated display case, a cooling system, a cooler, a refrigerator, a freezer, etc.

In some embodiments, the HVAC/Refrigeration unit 108 includes a charging port 122 and a plate 110. The plate 110 can include a code, a barcode, a quick response (QR) code, textual information, a serial number, a device identifier, etc., that is visible on the HVAC/Refrigeration unit 108 and can be scanned by the user device 106 (e.g., a smartphone, a tablet, etc.). In some embodiments, the charging port is configured to fluidly couple the service tool 124 with a refrigerant reservoir, with a conduit of the refrigeration loop, a tubular member of the refrigeration loop, etc. In some embodiments, the service tool 124 can be removably coupled with the HVAC/Refrigeration unit 108 via the charging port 122 so that the service tool 124 can charge (e.g., add refrigerant to the HVAC/Refrigeration unit 108) the HVAC/Refrigeration unit 108 or discharge the HVAC/Refrigeration unit 108 (e.g., remove refrigerant from the HVAC/Refrigeration unit 108).

In some embodiments, the service tool 124 includes a controller and/or a wireless transceiver configured to communicate with the controller 102. In some embodiments, the controller 102 is configured to communicate with the cloud computing system 104 and/or the user device 106. The cloud computing system 104 can represent multiple servers, processors, processing circuitry, a single server, a single processor, a single processing circuit, etc., configured to perform any of the operations and functions described herein.

When a technician arrives at the HVAC/Refrigeration unit 108, the technician may scan the plate 110 and establish communication with the controller 102 via a communications link (e.g., wireless communications) between the controller 102 and the user device 106. In some embodiments, the user device 106 communicates directly with the service tool 124. In some embodiments, the service tool 124 is configured to establish communication with the controller 102 through the user device 106. For example, the user device 106 may establish a local wireless local area network (WLAN), a hotspot, etc., and the service tool 124 and the controller 102 may join the network or the hotspot. In some embodiments, the service tool 124 is configured to report sensor data to the controller 102 indicating an amount of refrigerant that is added or removed from the HVAC/Refrigeration unit 108.

In some embodiments, the user device 106 is configured to determine, based on an image of the plate 110, a user input, a manually input serial number of the HVAC/Refrigeration unit 108, etc., an identifier (e.g., a serial number, an identification string, a specific identification (ID), etc.) for the HVAC/Refrigeration unit 108. In some embodiments, the user device 106 is configured to provide the identifier of the refrigeration equipment 108 to the cloud computing system 104. In some embodiments, the controller 102 is configured to provide the identifier of the refrigeration equipment 108 to the cloud computing system 104 with a corresponding amount of refrigerant that is added or removed from the HVAC/Refrigeration unit 108. The controller 102 may communicate with the service tool 124 directly or through the user device 106. In some embodiments, the controller 102 is configured to communicate with the cloud computing system 104 directly or through the user device 106. In some embodiments, the identifier of the HVAC/Refrigeration unit 108 is provided to the cloud computing system 104 along with a current date and the amount of refrigerant added or removed from the HVAC/Refrigeration unit 108.

HVAC/Refrigeration System

Figure 2:
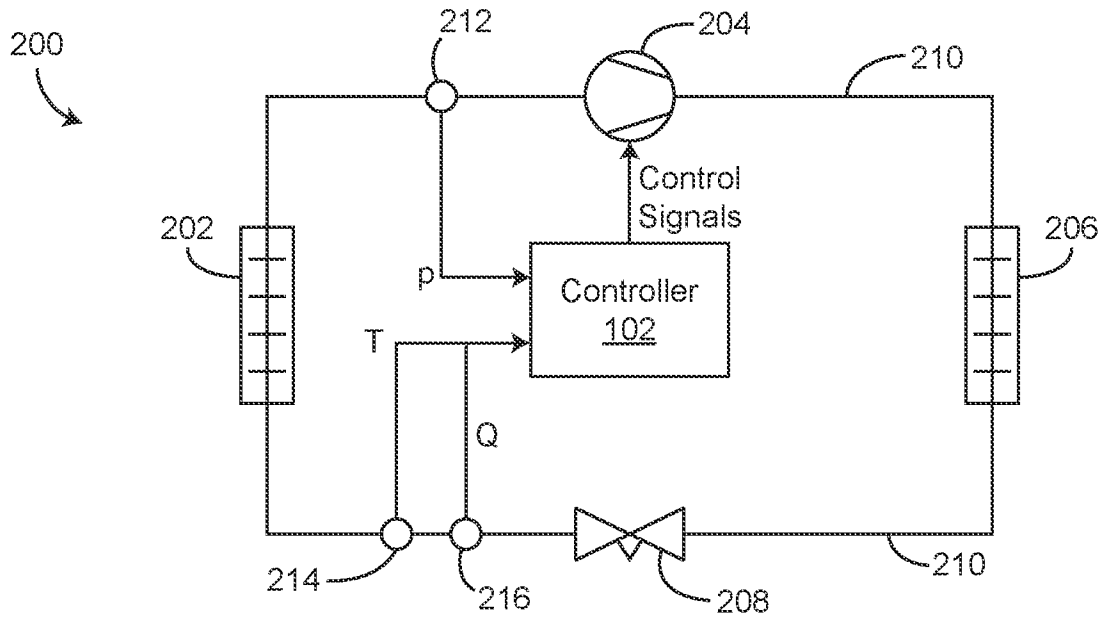
FIG. 2 is a diagram of the HVAC/Refrigeration system of the refrigerant tracking system of FIG. 1, according to some embodiments.

Referring particularly to FIG. 2, a HVAC/Refrigeration system 200 is shown (which may be a critically charged HVAC/Refrigeration system), according to some embodiments. The HVAC/Refrigeration system 200 may be included in the HVAC/Refrigeration unit 108, or the HVAC/Refrigeration unit 108 may be a component of the HVAC/Refrigeration system 200, all of which are fluidly coupled with each other in a loop via piping 210 (e.g., hoses, tubular members, conduits, etc.). The HVAC/Refrigeration system 200 is configured to cool a space (e.g., a volume, a refrigeration zone, etc.). The HVAC/Refrigeration system 200 includes a compressor 204, a condenser 206, an expansion valve 208, and an evaporator 202. The compressor 204 is configured to pressurize a refrigerant and drive the refrigerant through piping 210 to the condenser 206. The refrigerant passes through the condenser 206, cools and releases heat, and exits the condenser 206. The refrigerant is then driven through piping 210 to the expansion valve 208. The refrigerant passes through the expansion valve 208 and expands (to thereby cool) before entering the evaporator 202. The refrigerant is then provided to the evaporator 202 to absorb heat from the space to cool the space. After the refrigerant exits the evaporator 202, the refrigerant returns to the compressor 204.

The HVAC/Refrigeration system 200 also includes a pressure sensor 212 positioned on a suction side of the compressor 204. The pressure sensor 212 may be the pressure sensor 118 as shown in FIG. 1 and described in greater detail above. The pressure sensor 212 is configured to provide measurements of pressure of the refrigerant as the refrigerant enters the compressor 204. The HVAC/Refrigeration system 200 also includes a temperature sensor 214 that is positioned along the piping 210 before an inlet of the evaporator 202. The temperature sensor 214 can be the temperature sensor 114. In some embodiments, the temperature sensor 214 is configured to provide a temperature of the refrigerant prior to entry of the evaporator 202 to the controller 102. In some embodiments, the HVAC/Refrigeration system 200 includes a flow rate sensor 216 that is configured to measure a flow rate (e.g., volumetric flow rate, velocity, mass flow rate, etc.) (e.g., downstream of the expansion valve 208) and provide the flow rate (shown as Q) to the controller 102.

It should be understood that the refrigerant may be any type of refrigerant desired to be tracked and managed, such as, by way of non-limiting example, R32, 410A, R22, CO2, propane, etc., and the systems and methods described herein can apply to any HVAC/Refrigeration system or multiple HVAC/Refrigeration systems that use the same or different refrigerants.

The controller 102 can be configured to generate control signals for the compressor 204 and operate the compressor 204 based on any of the temperature, pressure, or flow rates obtained from the temperature sensor 214, the pressure sensor 212, or the flow rate sensor 216. In some embodiments, the controller 102 is configured to operate the compressor 204 using a closed loop control scheme (e.g., PID control, PI control, etc.). For example, the controller 102 can be configured to perform various control algorithms. In some embodiments, the charging port 122 is configured to allow the service tool 124 to fluidly couple with the charging port 122 so that the service tool 124 can remove refrigerant from the HVAC/Refrigeration system 200 and add new refrigerant from the HVAC/Refrigeration system 200, or add additional refrigerant to the HVAC/Refrigeration system 200.

System with Data

Figure 3:
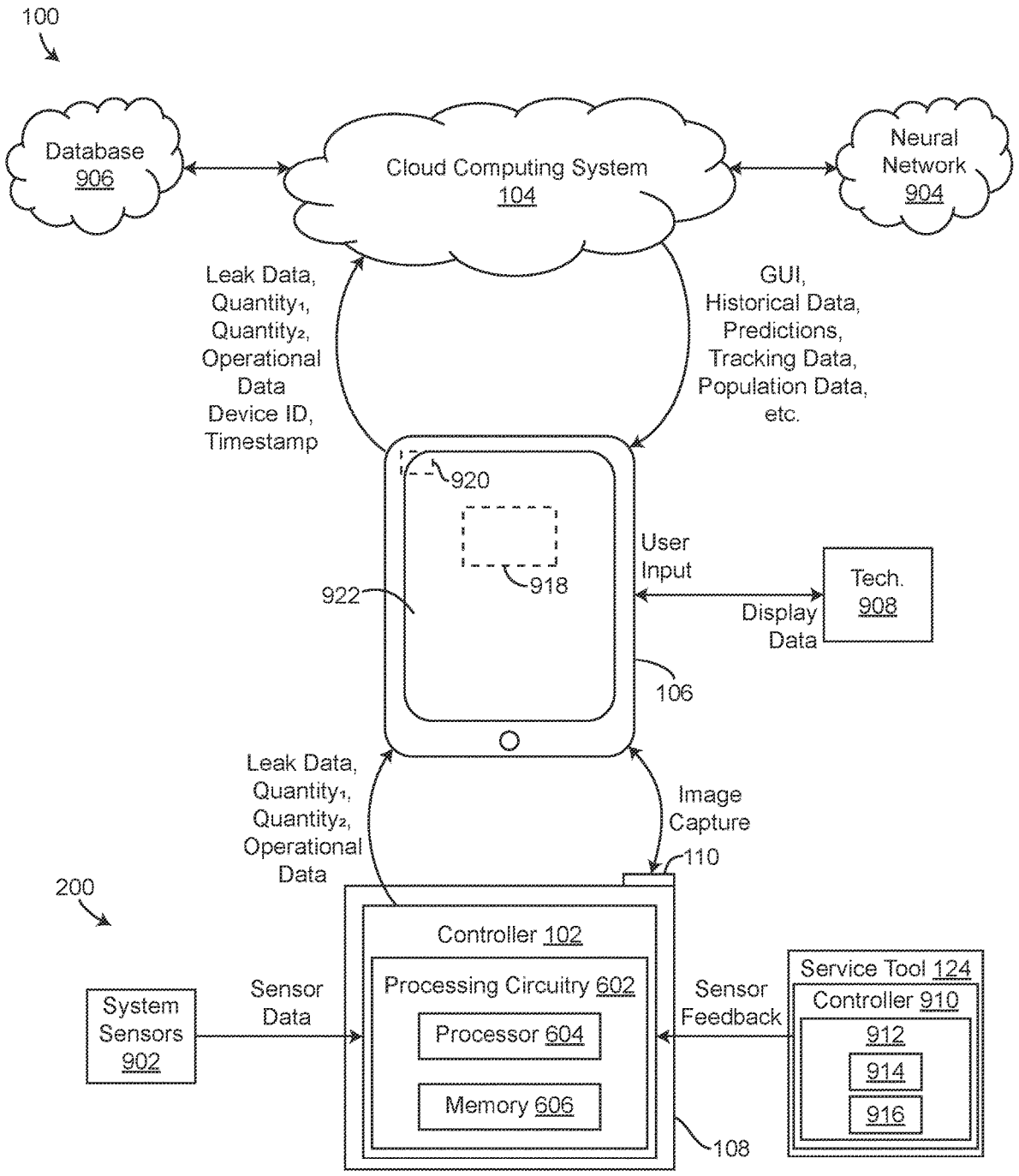
FIG. 3 is a block diagram of the refrigerant tracking system of FIG. 1 illustrating data transfer of the refrigerant tracking system, according to some embodiments.

Referring to FIG. 3, a diagram of the refrigerant tracking system 100 is shown, illustrating the transfer of data between the different levels of the refrigerant tracking system 100. The controller 102 is shown to obtaining sensor feedback from the service tool 124 and sensor data from system sensors 902 of the HVAC/Refrigeration system 200. In some embodiments, the sensor feedback obtained from the service tool 124 is obtained from any of a sensor of the service tool 124.

The controller 102 is shown to include processing circuitry 602 including a processor 604 and memory 606. Processing circuitry 602 can be communicably connected to a communications interface such that processing circuitry 602 and the various components thereof can send and receive data via the communications interface. Processor 604 can be implemented as a general purpose processor, an application specific integrated circuit (ASIC), one or more field programmable gate arrays (FPGAs), a group of processing components, or other suitable electronic processing components.

Memory 606 (e.g., memory, memory unit, storage device, etc.) can include one or more devices (e.g., RAM, ROM, Flash memory, hard disk storage, etc.) for storing data and/or computer code for completing or facilitating the various processes, layers and modules described in the present application. Memory 606 can be or include volatile memory or non-volatile memory. Memory 606 can include database components, object code components, script components, or any other type of information structure for supporting the various activities and information structures described in the present application. According to some embodiments, memory 606 is communicably connected to processor 604 via processing circuitry 602 and includes computer code for executing (e.g., by processing circuitry 602 and/or processor 604) one or more processes described herein.

In some embodiments, the controller 102 is implemented within a single computer (e.g., one server, one housing, etc.). In various other embodiments, controller 102 can be distributed across multiple servers or computers (e.g., that can exist in distributed locations).

The controller 102 (e.g., the processing circuitry 602) is shown receiving the sensor feedback from the service tool 124, and sensor data from the system sensors 902. In some embodiments, the controller 102 is wirelessly communicably coupled with the service tool 124 (e.g., with a controller 910 of the service tool 124). In some embodiments, the controller 102 is configured to directly wirelessly communicate with any of the sensors of the service tool 124 or HVAC/Refrigeration unit 108. In some embodiments, the service tool 124 (or sensors thereof) are configured to establish communication with the controller 102 through the user device 106, with the user device 106 acting as an intermediary or bridge device (e.g., to forward data between the service tool 124 and the controller 102).

The service tool 124 is shown to include the controller 910 which includes processing circuitry 912 including a processor 914 and memory 916. Processing circuitry 912 can be communicably connected to a communications interface such that processing circuitry 912 and the various components thereof can send and receive data via the communications interface. Processor 914 can be implemented as a general purpose processor, an application specific integrated circuit (ASIC), one or more field programmable gate arrays (FPGAs), a group of processing components, or other suitable electronic processing components.

Memory 916 (e.g., memory, memory unit, storage device, etc.) can include one or more devices (e.g., RAM, ROM, Flash memory, hard disk storage, etc.) for storing data and/or computer code for completing or facilitating the various processes, layers and modules described in the present application. Memory 916 can be or include volatile memory or non-volatile memory. Memory 916 can include database components, object code components, script components, or any other type of information structure for supporting the various activities and information structures described in the present application. According to some embodiments, memory 916 is communicably connected to processor 914 via processing circuitry 912 and includes computer code for executing (e.g., by processing circuitry 912 and/or processor 914) one or more processes described herein.

The controller 102 is configured to obtain sensor feedback from the service tool 124 and sensor data from the system sensors 902. In some embodiments, the controller 102 is configured to determine an amount of refrigerant added or removed from the HVAC/Refrigeration system 200.

Referring still to FIG. 3, the controller 102 is shown providing a first quantity of refrigerant, $Quantity_1$, a second quantity of refrigerant $Quantity_2$, and leak data to the user device 106, according to some embodiments. In some embodiments, the first quantity $Quantity_1$ is an amount (e.g., mass, weight, volume, etc.) of refrigerant removed from the HVAC/Refrigeration system 200 by the service tool 124. In some embodiments, the second quantity $Quantity_2$ is an amount (e.g., mass, weight, volume, etc.) of refrigerant added to the HVAC/Refrigeration system 200 by the service tool 124. The controller 102 can also provide any sensor data obtained from the leak sensors 112 of the HVAC/Refrigeration system 200 as the leak data, or may provide quantities of refrigerant that has leaked (e.g., since a previous refrigeration service) out of the HVAC/Refrigeration system 200 to the user device 106.

The user device 106 is configured to obtain a user input from the technician 908 or an image capture of the plate 110. In some embodiments, the user device 106 is a smartphone that is loaded with a mobile application. The mobile application may configure the controller 102 to establish communication with the controller 102, the controller 910 of the service tool 124, and/or the cloud computing system 104. In some embodiments, the mobile application also configures the user device 106 to perform any of the functionality as described herein, to present graphical user interfaces (GUIs), to process data, etc. In some embodiments, any of the data or image processing techniques described herein with reference to the user device 106 are performed by the cloud computing system 104. In some embodiments, the user device 106 includes processing circuitry 918 that is the same as or similar to the processing circuitry 602 or the processing circuitry 912 (e.g., including a processor and memory). In some embodiments, the user device 106 includes an imaging device 920 (e.g., a camera), and a display screen 922 (e.g., a touchscreen). In some embodiments, the user device 106 is a smartphone or a tablet.

In some embodiments, the technician 908 may view the plate 110, and enter the data on the plate 110 manually (e.g., via the touchscreen 922). The technician 908 can enter identification data of the HVAC/Refrigeration system 200 or the HVAC/Refrigeration unit 108. In some embodiments, the technician operates the user device 106 to obtain an image of the plate 110. The image of the plate 110 may include hand-written information, printed or textual information, an identification of the unit 108, etc. In some embodiments, the image of the plate 110 includes a QR code or a barcode so that the user device 106 can retrieve (e.g., from the cloud computing system 104 and the database 906), historical data, tracking data, predictions, etc., associated with the particular unit 108. In some embodiments, the user device 106 is configured to perform an image processing technique to extract the identification of the unit 108. In some embodiments, the user device 106 is configured to determine a timestamp (e.g., a date and time of day) at which the service is performed by the technician 908.

The user device 106 may also obtain operational data of the HVAC/Refrigeration system 200 (e.g., efficiency of the HVAC/Refrigeration system 200, coefficient of performance (COP) of the HVAC/Refrigeration system 200, energy consumption of the compressor 204, estimated degradation of the compressor 204, etc.) from the controller 102. In some embodiments, the user device 106 is configured to report any leak data, the first quantity $Quantity_1$, the second quantity $Quantity_2$, the operational data, the device ID, and the timestamp to the cloud computing system 104 as a datapoint. The datapoint can be used by the cloud computing system 104 to track refrigerant (e.g., across a population of HVAC/Refrigeration systems 200 such as in a building, across an entire state, across the entire country, etc.). In some embodiments, the cloud computing system 104 is configured to write the datapoint to the database 906. In some embodiments, the cloud computing system 104 is configured to obtain or retrieve previously obtained datapoints for the HVAC/Refrigeration system 200 or the unit 108 (e.g., for the particular system associated with the device ID), and provide any of the historical data, tracking data, population data (e.g., average leak data of similar types of HVAC/Refrigeration systems 200, average lifespan of similar types of HVAC/Refrigeration systems 200, amounts of refrigerant added or removed in a geographic area, etc.), to the user device 106. In some embodiments, the cloud computing system 104 is configured to manage, access, and retrieve data of the database 906. In some embodiments, the operational data provided from the controller 102 of the HVAC/Refrigeration system 200 includes subcooling data, superheating data, or enthalpy data of the HVAC/Refrigeration system 200, and power drawn by the HVAC/Refrigeration system 200 (e.g., Amps).

Refrigerant Management

Figure 7:
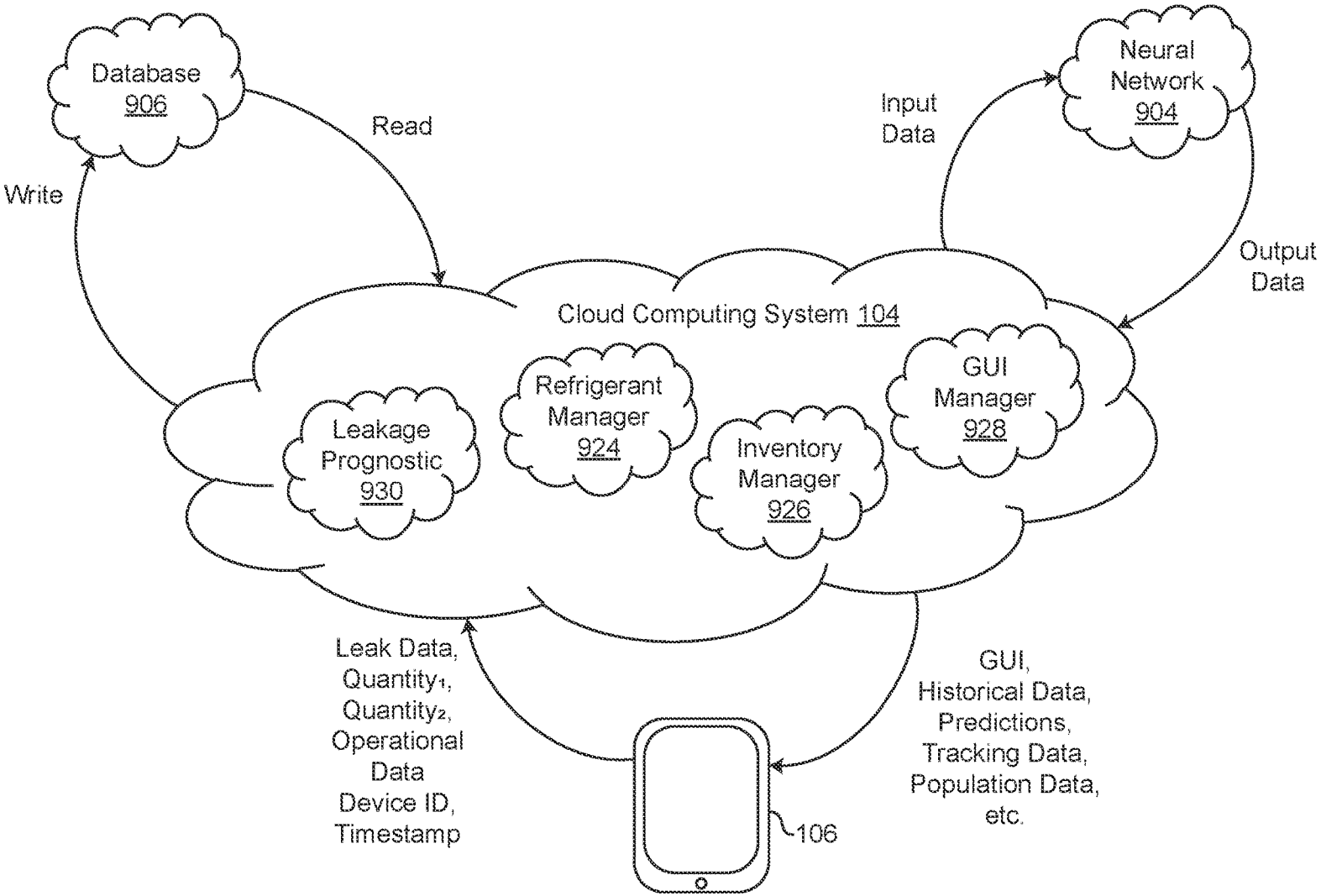
FIG. 7 is a diagram illustrating a cloud computing system of the refrigerant tracking system of FIG. 1 and FIG. 3 in greater detail, according to some embodiments.

Referring to FIGS. 3 and 7, the cloud computing system 104 can include a refrigerant manager 924 that is configured to track refrigerant consumption, addition, removal, leakage, etc., of the HVAC/Refrigeration system 200, and any other HVAC/Refrigeration systems. In some embodiments, the historical data can include a previous quantity of refrigerant that was added to or in the HVAC/Refrigeration system 200 (e.g., $Quantity_{prev}$). In some embodiments, the cloud computing system 104 is configured to estimate a quantity of refrigerant that has been consumed, $Quantity_{consumed}$, by the HVAC/Refrigeration system 200 since a previous service of the HVAC/Refrigeration system 200. For example, the cloud computing system 104 can determine the quantity of refrigerant that has been consumed based on the previous quantity of refrigerant that was in the HVAC/Refrigeration system 200, $Quantity_{prev}$, an amount of refrigerant removed from the HVAC/Refrigeration system 200 (e.g., $Quantity_{removed}$), and an amount of refrigerant added to the HVAC/Refrigeration system (e.g., $Quantity_{added}$). For example, the amount consumed between the previous service of the HVAC/Refrigeration system 200 and the current timestep may be determined by the cloud computing system as:

$$Quantity_{consumed,\Delta t}=Quantity_{added}-Quantity_{removed}$$

where $Quantity_{consumed,\Delta t}$ is a quantity of refrigerant consumed (e.g., that leaks out of the HVAC/Refrigeration system 200) between the current time and the previous time at which the HVAC/Refrigeration system 200 was serviced. In some embodiments, the cloud computing system 104 is configured to monitor and record the quantity of refrigerant that is consumed between the current time and the previous time.

In some embodiments, the cloud computing system 104 is configured to monitor the amount of refrigerant consumed between the current time and the previous time, $Quantity_{consumed,\Delta t}$, and store the amount or quantity of refrigerant consumed in the database 906 (e.g., by writing the amount or quantity of refrigerant consumed to the database 906). The cloud computing system can similarly read previous calculations of the quantity or amount of refrigerant consumed from the database 906, and provide a historical dataset of the quantity of refrigerant consumed of the HVAC/Refrigeration system 200. In some embodiments, the refrigerant manager 924 is also configured to determine a cumulative amount of refrigerant consumed by the HVAC/Refrigeration system 200 (e.g., since an installation of the HVAC/Refrigeration system 200, or since the systems and methods described herein have been used to track refrigerant).

The refrigerant manager 924 of the cloud computing system 104 can similarly track an amount of refrigerant added to the HVAC/Refrigeration system 200 (or any other HVAC/Refrigeration system) by reading and writing the database 906. In some embodiments, the cloud computing system 104 is also configured to track an amount of refrigerant removed from the HVAC/Refrigeration system 200 (or any other HVAC/Refrigeration system) by reading and writing the database 906. In this way, the cloud computing system 104 (e.g., the refrigerant manager 924) can monitor and track a currently estimated level of the refrigerant in the HVAC/Refrigeration system 200, an amount of refrigerant that is added at each service interval, an amount of refrigerant that is removed at each service interval, an amount of refrigerant that has been consumed by the HVAC/Refrigeration system 200 (over a previous interval, or over the lifetime of the HVAC/Refrigeration system 200), and/or an amount of refrigerant that has leaked from the HVAC/Refrigeration system 200 (over a previous time interval, or over the lifetime of the HVAC/Refrigeration system 200). The refrigerant manager 924 may track any of the historical or tracking data described herein for an entire population of different HVAC/Refrigeration systems (e.g., in different geographic locations), store any of the historical or tracking data described herein in the database 906, and retrieve and provide any of the historical or tracking data of a particular HVAC/Refrigeration system (e.g., the HVAC/Refrigeration system 200) to the technician 908 by providing requested or relevant historical data or tracking data to the user device 106.

In some embodiments, the cloud computing system 104 is configured to communicate with the neural network 904 to received prognostics or predictions of leakage events at any of the HVAC/Refrigeration systems 200 of a fleet. For example, the neural network 904 may be trained, based on performance data and a root cause analysis database to identify or predict leakage events based on performance data (e.g., operational data) and/or health data of the HVAC/

Refrigeration system 200 (e.g., amperage draw by the compressor 204). In some embodiments, predicted leak events are obtained from the neural network 904 as output data and used (e.g., by the GUI manager 928) to notify an operator, technician, fleet administrator, etc., regarding the likelihood or expectancy of a leakage event for any of, or all of, the HVAC/Refrigeration systems 200 of a fleet. In this way, the GUI may include leakage predictions or detection (e.g., that a leak event is currently occurring) for each HVAC/Refrigeration systems 200 of a fleet, so that maintenance can be scheduled either manually or automatically (e.g., at a time of the predicted leak event, in the near future if the leakage event is currently occurring, etc.). In some embodiments, detected leakage events are logged in the database 906 (e.g., as detected by the neural network 904 based on sensor data obtained from the HVAC/Refrigeration systems 200).

In some embodiments, the cloud computing system 104 includes a GUI manager 928. The GUI manager 928 can be configured to obtain the tracking or historical data from the database 906 (e.g., tracking or historical data of a particular HVAC/Refrigeration system or of a population of HVAC/Refrigeration systems), and provide the GUI along with the historical or tracking data, or population data to the user device 106. In some embodiments, the user device 106 is configured to display the GUI and any of the data provided by the cloud computing system 104 to the technician 908. The GUI can include tabular data, unit or system identification data, operational data of the systems, graphs, etc., to illustrate the historical or tracking data. In some embodiments, the GUI facilitates tracking the use and consumption of different types of refrigerants and facilitates the technician 908 identifying a lifetime consumption of refrigerant that is consumed by all HVAC/Refrigeration systems.

The GUI manager 928 can also be configured to generate a GUI that includes information regarding local laws or procedures for handling and using different types of refrigerants. For example, if legal status of a particular refrigerant changes and a particular refrigerant is banned due to environmental regulation, the GUI can include a notification that the regulations have changed, which units or HVAC/Refrigeration systems include the particular refrigerant, how much of the particular refrigerant is currently in each of the HVAC/Refrigeration systems, a cumulative amount of the particular refrigerant in multiple HVAC/Refrigeration systems, and prompt the technician 908 or a system administrator to initiate the replacement of the particular refrigerant with a new type of refrigerant. The GUI can also include instructions for proper procedure to remove and replace the particular type of refrigerant.

Figure 5:
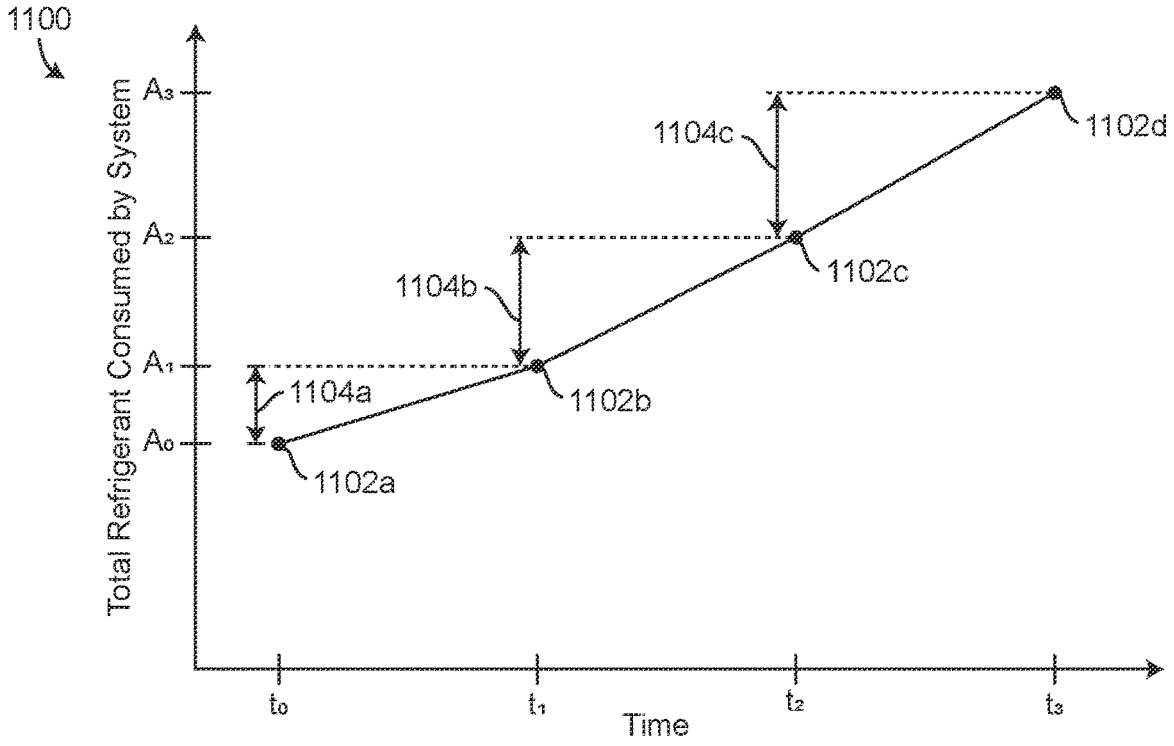
FIG. 5 is a graph illustrating total refrigerant consumed by a HVAC/Refrigeration system over time, according to some embodiments.
Figure 6:
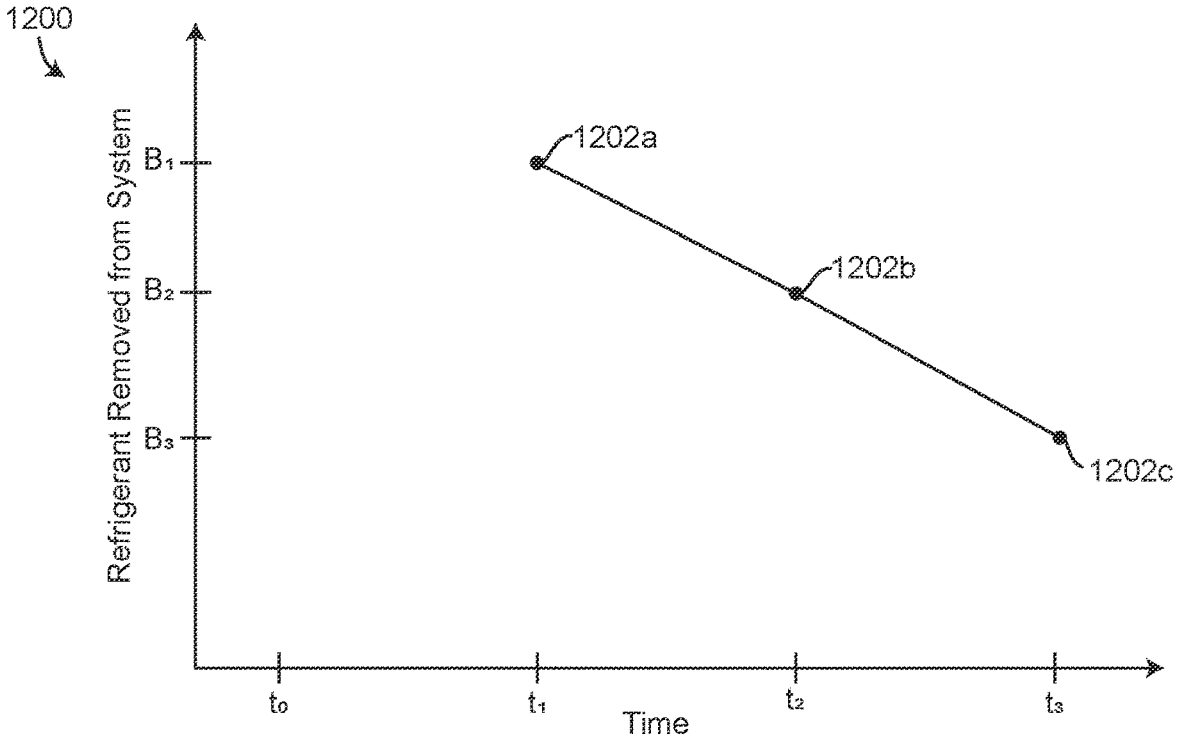
FIG. 6 is a graph illustrating an amount of refrigerant removed from a HVAC/Refrigeration system over time, according to some embodiments.

Referring particularly to FIGS. 5-6, graphs 1100 and 1200 illustrate total refrigerant consumed by the system over time and refrigerant removed from the system over time. Graphs 1100 and 1200 may illustrate quantities of refrigerant over time for a specific HVAC/Refrigeration system. Graphs 1100 and 1200 may be presented on the GUI that is provided to and displayed on the user device 106. In some embodiments, graph 1100 includes datapoints 1102 (e.g., datapoint 1102*a*, datapoint 1102*b*, datapoint 1102*c*, and datapoint 1102*d*), that illustrate total refrigerant consumed by the HVAC/Refrigeration system 200 over its lifetime. In some embodiments, datapoint 1102*a* illustrates an initial amount of refrigerant $A_0$ added to the system. In some embodiments, the initial amount of refrigerant is 0 when the HVAC/Refrigeration system 200 is first started. Between datapoint 1102*a* and datapoint 1102*b* (e.g., between times $t_0$ and $t_1$), the total refrigerant consumed increases by amount 1104*a* (e.g., an amount of refrigerant lost between the installation of the HVAC/Refrigeration system 200 and the first servicing of the HVAC/Refrigeration system 200). Between datapoint 1102*b* and 1102*c*, the total refrigerant consumed increases by amount 1104*b*, and similarly between datapoint 1102*b* and datapoint 1102*c*, the total refrigerant increases by amount 1104*c*. Each of the different datapoints indicate when a different service is performed to add or remove refrigerant from the system. A difference in the refrigerant quantity between the datapoint 1102 and the datapoint 1102*d* indicates a total amount of refrigerant that has been lost (e.g., to the environment) by the HVAC/Refrigeration system 200.

Graph 1200 illustrates refrigerant removed from the HVAC/Refrigeration system 200 over time. As shown in FIG. 6, at time $t_0$, when the HVAC/Refrigeration system 200 is first installed and charged, no refrigerant is removed from the system. At datapoint 1202*a* (e.g., at the first servicing of the HVAC/Refrigeration system 200 at time $t_1$) a first quantity $B_1$ of refrigerant is removed from the HVAC/Refrigeration system 200. Similarly, datapoints 1202*b* and 1202*c* illustrate a second quantity $B_2$ and a third quantity $B_3$ being removed from the HVAC/Refrigeration system 200 at servicing at times $t_2$ and $t_3$. As shown in FIG. 6, the amount of refrigerant being removed from the HVAC/Refrigeration system 200 over time decreases, which indicates that the HVAC/Refrigeration system 200 is increasingly leaking or losing refrigerant.

In some embodiments, the cloud computing system 104 is configured to monitor the total refrigerant consumed by the HVAC/Refrigeration system 200 (e.g., as shown in FIG. 5), or the cumulative or total amount of refrigerant that is added to the HVAC/Refrigeration system 200 (e.g., as shown in FIG. 7). In some embodiments, if the total refrigerant consumed by the HVAC/Refrigeration system 200 or the total amount of refrigerant added to the HVAC/Refrigeration system 200 over its lifetime or between subsequent servicing operations exceeds a threshold amount (e.g., some percentage of an equipment inventory amount), the cloud computing system 104 may generate an alert that is provided to the technician 908 via the user device, or to a system manager to initiate corrective action of the HVAC/Refrigeration system 200 (e.g., replace equipment of the HVAC/Refrigeration system 200, take the HVAC/Refrigeration system 200 offline for comprehensive leak identification and repair, etc.).

Figure 4:
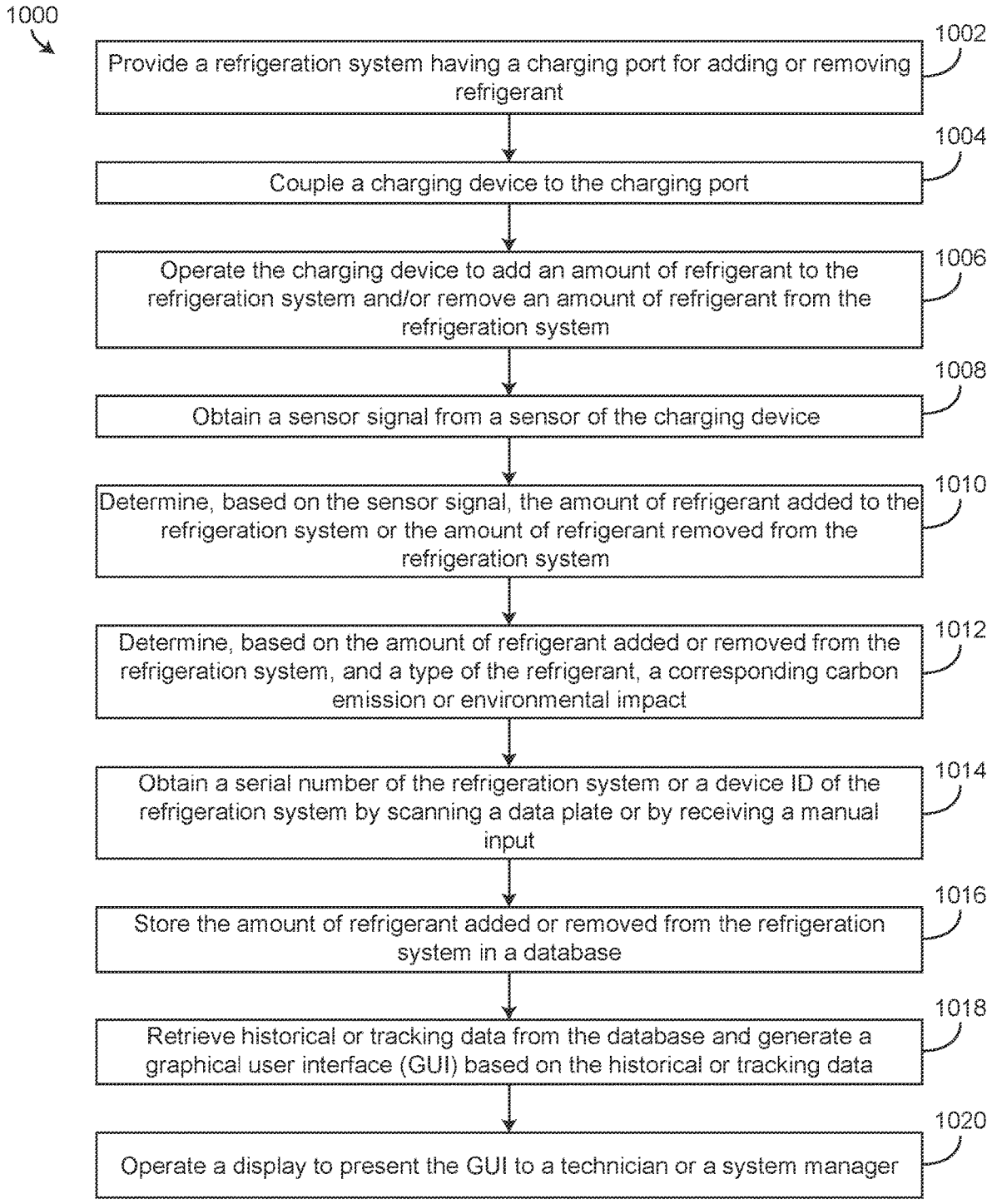
FIG. 4 is a flow diagram of a process for tracking an amount of refrigerant added to, removed from, or present in a HVAC/Refrigeration system, according to some embodiments.

Referring to FIG. 4, a process 1000 for determining an amount of refrigerant added to, removed from, or consumed by a HVAC/Refrigeration system, and for tracking refrigerant is shown, according to some embodiments. The process 1000 includes steps 1002-1020 and can be performed by the refrigerant tracking system 100.

Process 1000 includes providing a HVAC/Refrigeration system having a charging port for adding or removing refrigerant (step 1002), according to some embodiments. In some embodiments, the HVAC/Refrigeration system is the HVAC/Refrigeration system 200. In some embodiments, the charging port is the charging port 122, or a coupler that is configured to receive a tubular member to fluidly couple the tubular member with a refrigerant reservoir or one or more pipes of the HVAC/Refrigeration system 200.

Process 1000 includes coupling a charging device to the charging port (step 1004), according to some embodiments. In some embodiments, the charging device is the service tool 124. In some embodiments, the charging device is configured to add or remove refrigerant from the system. The charging device can include a tank or reservoir of refrigerant for adding refrigerant to the system. In some embodiments, the charging device includes an empty tank or reservoir for refrigerant that is removed from the HVAC/Refrigeration system (e.g., a HVAC/Refrigeration unit such as a refrigerated display case). In some embodiments, the tank is interchangeable so that a technician can fill an empty tank with refrigerant from the HVAC/Refrigeration system, then replace the tank with a tank that is full of new refrigerant, and add the new refrigerant to the HVAC/Refrigeration system. In some embodiments, the technician does not remove the refrigerant from the system but only adds new or additional refrigerant to charge the HVAC/Refrigeration system to full. Coupling the charging device with the charging port can define a fluid flow path between a tank or reservoir of the charging device and an inner volume or refrigerant reservoir of the HVAC/Refrigeration system. Step 1004 can be performed by a technician when the technician arrives at the HVAC/Refrigeration system to perform servicing.

Process 1000 includes operating the charging device to add an amount of refrigerant to the HVAC/Refrigeration system and/or to remove an amount of refrigerant from the HVAC/Refrigeration system (step 1006), according to some embodiments. In some embodiments, the charging device includes a pump or compressor that is configured to drive refrigerant into or out of the HVAC/Refrigeration system. Refrigerant removed from the HVAC/Refrigeration system can be stored in the reservoir or tank of the charging device. Refrigerant added to the HVAC/Refrigeration system can be driven from the reservoir or tank of the charging device into the HVAC/Refrigeration system. Step 1006 can be performed by the technician and the pump or compressor. In some embodiments, the reservoir or the tank includes a propellant gas to discharge the refrigerant into the HVAC/Refrigeration system.

Process 1000 includes obtaining a sensor signal from a sensor of the charging device (step 1008), according to some embodiments. In some embodiments, the sensor signal indicates an amount of refrigerant added or removed. In some embodiments, the sensor signal is obtained by a controller (e.g., controller 910, or controller 102).

Process 1000 includes determining, based on the sensor signal, the amount of refrigerant added to the HVAC/Refrigeration system or the amount of refrigerant removed from the HVAC/Refrigeration system (step 1010), according to some embodiments. In some embodiments, step 1010 is performed by the controller 910, the controller 102, the user device 106, or the cloud computing system 104. In some embodiments, step 1010 include determining a mass, volume, or weight of refrigerant that is added or removed from the HVAC/Refrigeration system. In some embodiments, step 1010 includes using one or more relationships, functions, equations, etc., to determine a speed or flow rate of refrigerant that is added or removed from the HVAC/Refrigeration system (e.g., flowing through a tubular member of the service tool 124), and integrating the speed or flow rate of refrigerant to determine a quantity of refrigerant provided into or removed from the HVAC/Refrigeration system.

Process 1000 includes determining, based on the amount of refrigerant added or removed from the HVAC/Refrigeration system, and a type of the refrigerant, a corresponding carbon emission or environmental impact (step 1012), according to some embodiments. In some embodiments, step 1012 is performed by the controller 102, the controller 910, the user device 106, or the cloud computing system 104. In some embodiments, determining the corresponding carbon emission includes determining a carbon dioxide (CO2) emission or environmental impact of the amount of refrigerant that is put into service in the HVAC/Refrigeration system (e.g., the amount of refrigerant added to the HVAC/Refrigeration system). In some embodiments, the corresponding CO2 emissions or environmental impact is determined based on a value of global-warming potential (GWP) for the type of refrigerant, and the amount of refrigerant added to the HVAC/Refrigeration system.

Process 1000 includes obtaining a serial number of the HVAC/Refrigeration system or a device ID of the HVAC/Refrigeration system by scanning a data plate or by receiving a manual input (step 1014), according to some embodiments. In some embodiments, step 1014 is performed by capturing an image of the data plate (e.g., an image of a QR code, an image of a barcode, an image of textual information, etc.) with a smartphone or user device, and performing an image analysis based on the image to determine the serial number of the HVAC/Refrigeration system or to determine the device ID of the HVAC/Refrigeration system. In some embodiments, the technician may manually input the serial number or the device ID (e.g., via the user device or the smartphone). In some embodiments, the device ID is a unique identifier of the HVAC/Refrigeration system.

Process 1000 includes storing the amount of refrigerant added or removed from the HVAC/Refrigeration system in a database (step 1016), according to some embodiments. In some embodiments, the amount of refrigerant added or removed from the HVAC/Refrigeration system is tied with or associated with the device ID or serial number of the HVAC/Refrigeration system. In some embodiments, any data obtained from the HVAC/Refrigeration system (including operational data, efficiency data, COP, amount of refrigerant added, amount of refrigerant removed, amount of refrigerant that the HVAC/Refrigeration system has leaked, etc.) is stored in the database. The database may be the database 906 and can be managed by the cloud computing system 104. In some embodiments, the database is a cloud structured query language (SQL) server. The database may include similar data of any number of HVAC/Refrigeration systems (e.g., different makes, models, etc.). In some embodiments, the database includes historical or tracking data of the refrigerant added or removed from each of the different HVAC/Refrigeration systems, historical operational data of the different HVAC/Refrigeration systems, etc. The database may be accessible to a cloud computing system for use in tracking refrigerants, tracking refrigerant inventory, managing inventory, etc. The database may include entries for any of a manufacturer, a model number, a serial number, a manufacture date, a refrigerant type, a current refrigerant level, a refrigerant capacity, a factory refrigerant charge date, CO2 emissions equivalent, etc., for any of the HVAC/Refrigeration systems.

Process 1000 includes retrieving historical or tracking data from the database and generating a graphical user interface (GUI) based on the historical or tracking data (step 1018) and operating a display to present the GUI to a technician or a system manager (step 1020), according to some embodiments. In some embodiments, the GUI is configured to display historical data of refrigerant added, removed, etc., from the HVAC/Refrigeration system. The GUI may also include population data of similar types or different types of HVAC/Refrigeration systems. The GUI may also include prompts regarding new refrigerant policies (e.g., if the type of refrigerant that is currently in the HVAC/Refrigeration system should be replaced or is outdated). The GUI can include any graphs, charts, tabular data, textual data, etc. In some embodiments, the GUI includes any of the graphs 1100 or 1200, or similar graphs. In some embodiments, the display is a touchscreen or display screen of the user device 106 (e.g., a smartphone, a tablet, etc.).

Inventory Management

Referring to FIGS. 3 and 7-9, the cloud computing system 104 can be configured to communicate with the user device 106 to provide information regarding inventory management. The cloud computing system 104 is shown in FIG. 7 to include an inventory manager 926. The inventory manager 926 may communicate with the database 906 and collect, sort, and present data for inventory management. The GUI manager 928 may work in cooperation with the inventory manager 926 to generate a GUI for presentation on the user device 106. As discussed in greater detail above, the user device 106 can be used to capture an image of the plate 110. The user device 106, or the cloud computing system 104 can use the image of the plate 110 to extract information (e.g., by performing an image analysis technique), and store the extracted information in the database 906 as inventory data. The inventory data can include any of the information shown in table 1400 of FIG. 8. For example, the inventory data can include manufacturer information, model number information, serial number information, manufactured date information, refrigerant type, refrigerant level, refrigerant capacity, factory refrigerant charge level or date, etc., for each of multiple HVAC/Refrigeration systems or units in a fleet. In some embodiments, the table 1400 shown in FIG. 8 is included in the GUI that is presented to the technician or the system manager via the user device 106, or via a webpage. In some embodiments, the GUI includes high-level information such as a total number of units in the fleet, a total number of a particular type of units, a total quantity of refrigerant in service, an average life of the units, etc. Any of the information presented on the GUI may be determined by the cloud computing system 104, or more particularly, by the inventory manager 926 and the GUI manager 928. Advantageously, storing inventory data facilitates improved tracking and management of assets for a system manager.

The inventory manager 926 can use statistical clustering and outlier techniques to identify one or more HVAC/Refrigeration systems or units that regularly consume large amounts of refrigerant relative to other HVAC/Refrigeration units or systems (e.g., relative to similar types of HVAC/Refrigeration systems or units). In some embodiments, the GUI manager 928 is configured to generate a GUI that highlights these units for presentation to the technician 908 or a system manager so that the system manager may initiate further inspection or repair of the units or HVAC/Refrigeration systems that are outliers in terms of refrigeration consumption, regularly have low refrigerant levels, etc.

The inventory data may also include an estimation of an amount of life remaining for each of the HVAC/Refrigeration units of the fleet. In some embodiments, the inventory manager 926 is configured to estimate, based on a stage of health, health data, historical operational data, expected lifetime of a particular type of HVAC/Refrigeration system, etc., an amount of remaining life for each of the HVAC/Refrigeration systems or units of the fleet. The estimated amount of life remaining can be included in the table 1400, or the GUI that is viewable by the systems manager or the technician 908. In some embodiments, the estimation of the amount of life remaining for each of the HVAC/Refrigeration units is determined by a neural network 904. For example, the cloud computing system 104 can provide input data to the neural network 904 regarding any of the HVAC/Refrigeration units such as performance data, operational data, installation date, etc., and receive a prediction of a remaining amount of life from the neural network 904 as output data.

Figure 9:
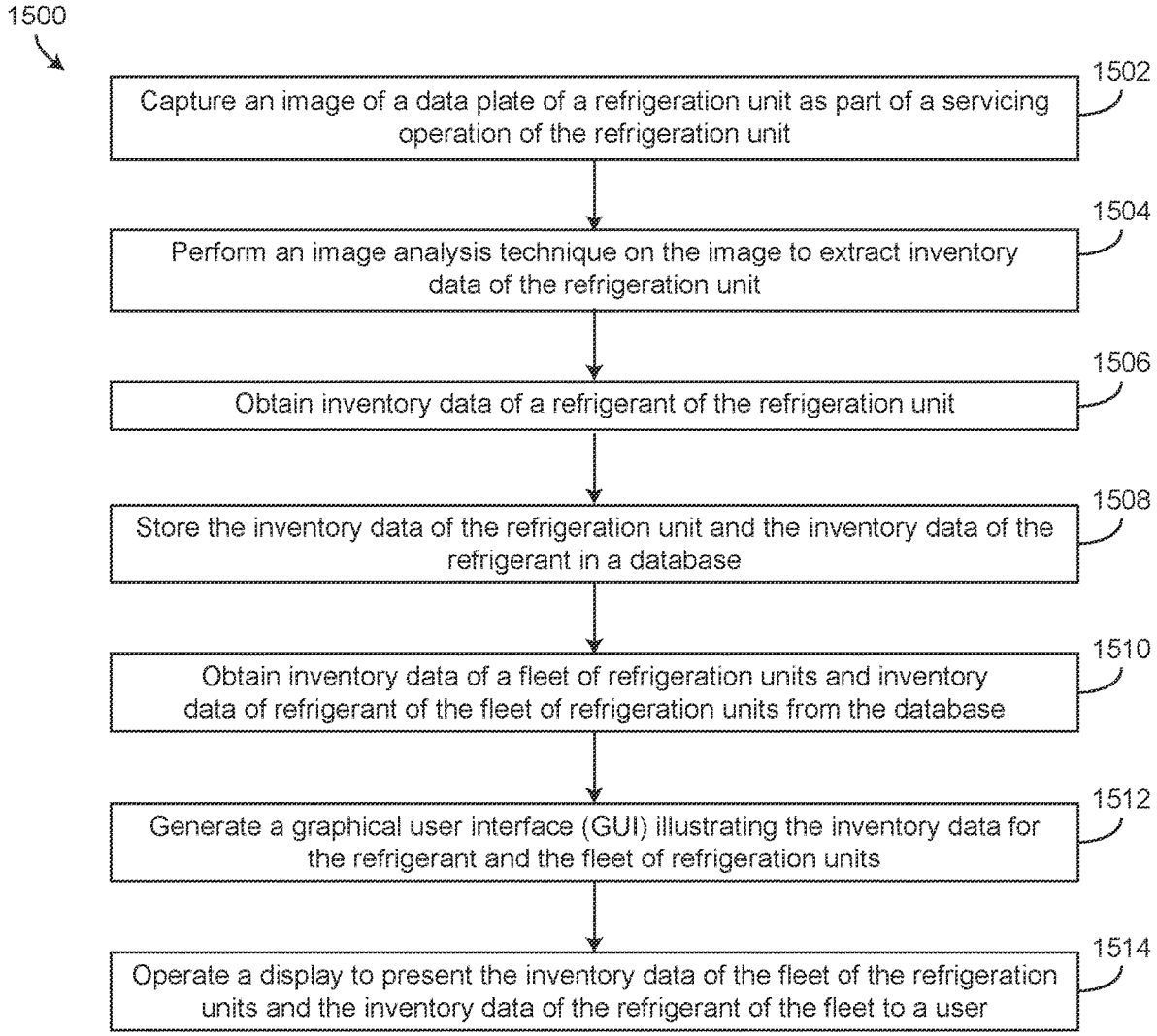
FIG. 9 is a flow diagram of a process for tracking inventory data of a fleet of HVAC/Refrigeration systems, according to some embodiments.

Referring particularly to FIG. 9, a process 1500 for tracking inventory of HVAC/Refrigeration units is shown, according to some embodiments. The process 1500 may be performed as a portion of or a step of the process 1000. In some embodiments, the process 1500 and the process 1500 are performed in response to performing steps 1002-1004 of process 1000, or at least partially concurrently with any of the steps of process 1000. The process 1500 includes steps 1502-1514 and may be performed by the refrigerant tracking system 100.

Process 1500 includes capturing an image of a data plate of a HVAC/Refrigeration unit as part of a servicing operation of the HVAC/Refrigeration unit (step 1502), according to some embodiments. In some embodiments, step 1502 is performed by the technician and the user device 106. For example, the user device 106 may be a smartphone, and the technician can capture (e.g., through a mobile application) the image of the data plate of the HVAC/Refrigeration unit. In some embodiments, the image that is captured in step 1502 or data extracted from the data plate is/are uploaded to the cloud computing system 104.

Process 1500 includes performing an image analysis technique on the image to extract inventory data of the HVAC/Refrigeration unit (step 1504), according to some embodiments. In some embodiments, the inventory data of the HVAC/Refrigeration unit that is extracted in step 1504 includes data regarding a manufacturer of the HVAC/Refrigeration unit, a model number of the HVAC/Refrigeration unit, a serial number of the HVAC/Refrigeration unit, a manufactured date of the HVAC/Refrigeration unit, a type of refrigerant used by the unit, and a factory refrigerant charge date. Step 1504 may be performed locally at the user device 106, or may be performed by the cloud computing system 104. For example, the mobile application can utilize the cloud computing system 104 to perform the image analysis technique to improve computing efficiency of the user device 106.

Process 1500 includes obtaining inventory data of a refrigerant of the HVAC/Refrigeration unit (step 1506), according to some embodiments. In some embodiments, the inventory data of the refrigerant includes an amount of refrigerant that is currently in the unit, an amount of refrigerant added to the unit, a current refrigerant level of the unit, etc. In some embodiments, step 1506 includes performing any of the steps of process 1000 to obtain the inventory data of the refrigerant of the unit. In some embodiments, step 1506 is performed by the cloud computing system 104.

Process 1500 includes storing the inventory data of the HVAC/Refrigeration unit and the inventory data of the refrigerant in a database (step 1508), according to some embodiments. In some embodiments, step 1508 includes writing any of the inventory data obtained in steps 1502-1506 in the database 906. In some embodiments, step 1508 is performed by the cloud computing system 104. Process 1500 may include performing steps 1502-1508 for each unit in a fleet of HVAC/Refrigeration units.

Process 1500 includes obtaining inventory data of a fleet of HVAC/Refrigeration units and inventory data of refrigerant of the fleet of HVAC/Refrigeration units from the database (step 1510), according to some embodiments. In some embodiments, step 1510 is performed by the cloud computing system 104. In some embodiments, step 1510 is performed by reading information from the database 906 that has previously been collected in multiple iterations of steps 1502-1508.

Process 1500 includes generating a graphical user interface (GUI) illustrating the inventory data for the refrigerant and the fleet of HVAC/Refrigeration units (step 1512), according to some embodiments. In some embodiments, step 1512 is performed by the GUI manager 928. In some embodiments, the GUI generated in step 1512 includes the table 1400. In some embodiments, the GUI illustrates the inventory data for the entire fleet of HVAC/Refrigeration units. In some embodiments, the inventory data includes high-level information regarding a number of HVAC/Refrigeration units, a number of particular types of HVAC/Refrigeration units, different types of refrigerants that are currently in use, etc.

Process 1500 includes operating a display to present the inventory data of the fleet of the HVAC/Refrigeration units and the inventory data of the refrigerant of the fleet to a user (step 1514), according to some embodiments. In some embodiments, step 1514 includes presenting the GUI on the user device 106 (e.g., to provide the GUI to the technician 908) or presenting the GUI on a desktop computer (e.g., in response to the desktop computer accessing a webpage). Step 1514 can be performed by the user device 106 (e.g., by a touch screen) and can be facilitated by a mobile application that is installed on the user device 106. The GUI can also include options to add a new asset or refrigerant unit, and the database 906 may be updated or populated with any of the inventory data when the new asset is serviced or when the technician connects the user device 106 to a controller of the new asset.

Leakage Prognostic and Diagnostic

Referring to FIG. 7, the cloud computing system 104 includes a leakage prognostic 930 that is configured to predict a leakage event of one of the units 200 based on machine learning, a root cause database, and operational data (and/or mechanical health data) obtained from the units 200. In some embodiments, the cloud computing system 104 uses subcooling temperature or values of subcooling obtained from the unit 200 over time to predict the leakage event at the units 200 before the leakage event occurs. The cloud computing system 104 may also use a root cause database that includes subcooling or performance data of a HVAC/Refrigeration unit (e.g., a critically charged HVAC/Refrigeration unit) preceding or leading up to a leakage event and a corresponding root cause (e.g., determined by physical inspection and a report). In some embodiments, the cloud computing system 104 uses the neural network 904, machine learning (ML), or artificial intelligence (AI) to compare currently obtained subcooling or performance data from the units 200 to the various entries in the root cause database to identify correspondence and accordingly whether a leakage event will occur in the future in addition to a root cause of the leakage event. In this way, the cloud computing system 104 can predict a leakage event at the HVAC/Refrigeration units 200 based on subcooling or performance data obtained from the HVAC/Refrigeration units 200. In some embodiments, the subcooling data (e.g., temperature or enthalpy) is performance data obtained from a sensor or a collection of sensors that are positioned at an outlet of the condenser 206, at an inlet of the expansion valve 208, or along the piping system 210 between the outlet of the condenser 206 and the inlet of the expansion valve 208.

In some embodiments, the cloud computing system 104 and the leakage prognostic 930 are also configured to obtain mechanical health data from the HVAC/Refrigeration units 200 (e.g., amperage or power drawn at the compressor 204, voltage across the compressor 204, etc.) and use the mechanical health data to account for a mechanical health of the HVAC/Refrigeration units 200 when predicting if a leakage event will occur. In some embodiments, the leakage prognostic 922 is configured to account for the mechanical health of the HVAC/Refrigeration unit 200 to decrease the likelihood of falsely predicting a leakage event at one of the HVAC/Refrigeration units 200.

In some embodiments, the leakage prognostic 922 is also configured to update the root cause analysis database or the database 906 with new entries, and retrain the neural network 904 periodically or update parameters of the neural network 904 based on the newly obtained data of the root cause database. In some embodiments, a technician performing an inspection at the HVAC/Refrigeration units 200 can provide updates via the user device 106 informing the cloud computing system 104 and the leakage prognostic 922 regarding a root cause of failure or leakage at the HVAC/Refrigeration unit 200. In some embodiments, the root cause database is initially populated or created by collecting reports from technicians regarding root cause of failure or leakage event, as well as collected performance data (e.g., subcooling data) leading up to the failure or the leakage event.

In some embodiments, the leakage prognostic 922 is also configured to perform a diagnostic technique to identify if a leak is currently occurring at any of the HVAC/Refrigeration units 200. In some embodiments, the leakage prognostic 922 is configured to compare currently obtained subcooling temperature of the HVAC/Refrigeration units 200 to a threshold value. If the currently obtained or recently obtained subcooling temperature of the HVAC/Refrigeration units 200 is greater than the threshold value, the leakage prognostic 922 determines that the HVAC/Refrigeration unit 200 is currently experiencing a leakage event.

In some embodiments, the leakage prognostic 922 is configured to predict the leakage event, as well as a root cause of the leakage event at the HVAC/Refrigeration units 200. The leakage prognostic 922 may provide the leakage event predictions and the root cause of the leakage events to the GUI manager 928 which may provide the prediction of the leakage event, the detection (e.g., diagnostic) of leaks at the HVAC/Refrigeration units 200, the root cause of the predicted leakage event, etc., to the user device 106 on the GUI. In some embodiments, the cloud computing system 104 or the GUI manager 928 are configured to notify a technician, a fleet manager, a building manager, a manufacturer, etc., regarding the predicted leakage event and the expected root cause at the HVAC/Refrigeration units 200 so that the root cause of the leakage events at the HVAC/Refrigeration units 200 can be addressed (e.g., fixed) before the leakage event occurs. In some embodiments, the fleet manager may dispatch a technician or maintenance personnel in response to the leakage prognostic predicting a leakage event at one of the HVAC/Refrigeration units 200. In some embodiments, alerts regarding the predicted leakage event (e.g., as predicted by the leakage prognostic 922), can be provided to appropriate personnel (e.g., the technician, the fleet manager, the building manager or administrator, a manufacturer, maintenance personnel, etc.) via a text message, a notification on a smartphone (e.g., the user device 106), an email, an automated phonecall, presentation on a webpage, etc.

In this way, the cloud computing system 104 may be a smart system that uses AI or ML (e.g., the neural network 904) to identify trends, patterns, anomalies, etc., in data from any of the HVAC/Refrigeration systems 200. The cloud computing system 104 can use population wide data from all of the HVAC/Refrigeration systems 200 to train the neural network 904 to preemptively predict an anomaly (e.g., a leakage event, breakage of a component, etc.) of the HVAC/Refrigeration system 200. In this way, historical data obtained from other HVAC/Refrigeration systems or units 200 can be used to predict if another HVAC/Refrigeration system 200 will experience an anomaly. The cloud computing system 104 can also obtain and use data provided by technicians when the technicians perform a checkup or repair at the HVAC/Refrigeration systems 200 (e.g., replacing a component, performing an inspection, etc.). The data from the technicians can be provided via the user device 106, and may include an identification of a cause of failure (e.g., a root cause) at the HVAC/Refrigeration system 200 that the technician is performing an inspection. The neural network 904 can be trained to identify patterns in any operational data of the HVAC/Refrigeration systems 200 leading up to a failure event (e.g., an anomaly) so that the neural network 904 can preemptively predict anomalies at the HVAC/Refrigeration systems 200. Once trained, the neural network 904 can use currently obtained operational or mechanical health data from the HVAC/Refrigeration systems 200 or from individual components of the HVAC/Refrigeration systems 200 to predict a future anomaly at each HVAC/Refrigeration system 200. The GUI manager 928 can use any predictions for the HVAC/Refrigeration systems 200 to generate the GUI shown in FIG. 9. For example, the table 1400 may include a column that illustrates a predicted failure (e.g., a predicted anomaly) at each HVAC/Refrigeration system 200 (or likelihood of the predicted failure) so that a technician that views the table 1400 can prioritize preemptively repairing or inspecting HVAC/Refrigeration systems 200 or units that have a high likelihood of failure or a predicted failure in the near future.

Configuration of Exemplary Embodiments

As utilized herein, the terms "approximately", "about", "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claim.

It should be noted that the terms "exemplary" and "example" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like, as used herein, mean the joining of two members directly or indirectly to one another. Such joining may be stationary (e.g., permanent, etc.) or moveable (e.g., removable, releasable, etc.). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," "between," etc.) are merely used to describe the orientation of various elements in the figures. It should be noted that the orientation of various elements may differ according to other exemplary embodiments, and that such variations are intended to be encompassed by the present disclosure.

Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, Z, X and Y, X and Z, Y and Z, or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

It is important to note that the construction and arrangement of the systems as shown in the exemplary embodiments is illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements. It should be noted that the elements and/or assemblies of the components described herein may be constructed from any of a wide variety of materials that provide sufficient strength or durability, in any of a wide variety of colors, textures, and combinations. Accordingly, all such modifications are intended to be included within the scope of the present inventions. Other substitutions, modifications, changes, and omissions may be made in the design, operating conditions, and arrangement of the preferred and other exemplary embodiments without departing from scope of the present disclosure or from the spirit of the appended claim.

What is claimed is:

1. A system for tracking refrigerant of a HVAC/refrigeration or heating unit, the system comprising:

a HVAC/Refrigeration system configured to circulate a refrigerant in the HVAC/Refrigeration unit to cool a space, the HVAC/Refrigeration system comprising a service port for defining a fluid pathway into or out of an inner volume of a tubular member of the HVAC/Refrigeration system; and processing circuitry configured to:

obtain the signal from a sensor of a service tool;

determine, based on a signal, at least one of an amount of refrigerant added to the HVAC/Refrigeration system or an amount of refrigerant removed from the HVAC/Refrigeration system;

determine, based on at least one of the amount of refrigerant added to the HVAC/Refrigeration system or the amount of refrigerant removed from the HVAC/Refrigeration system, a current refrigerant level in the HVAC/Refrigeration system;

store at least one of the amount of refrigerant in the HVAC/Refrigeration system, the amount of refrigerant added to the system, or the amount of refrigerant removed from the system in a database;

operate a display to provide an inventory tracking report illustrating an amount of refrigerant present in the HVAC/Refrigeration system and an amount of refrigerant consumed over a lifetime of the HVAC/Refrigeration system;

predict, using machine learning and a root cause database, a leakage event, a predicted time of the leakage event, and a root cause of the leakage event, wherein the leakage event is a reduction of the refrigerant in the HVAC/Refrigeration system, based on (i) subcooling temperature data of the HVAC/Refrigeration system and (ii) mechanical health data of at least a compressor of the HVAC/Refrigeration system, the root cause database comprising a plurality of entries of leakage events and subcooling temperature data leading up to the leakage event; and automatically initiate an activity to perform maintenance on the HVAC/Refrigeration system by the predicted time of the leakage event.

2. The system of claim 1, wherein the processing circuitry is configured to obtain, based on a user input, or based on a captured image, a unique identifier of the HVAC/Refrigeration system, wherein the unique identifier is associated with the amount of refrigerant, the amount of refrigerant added to the HVAC/Refrigeration system, or the amount of refrigerant removed from the HVAC/Refrigeration system and the unique identifier is stored in the database.

3. The system of claim 2, wherein the processing circuitry is further configured to obtain, based on a user input, or based on the captured image, a type of refrigerant that is currently in the HVAC/Refrigeration system, wherein the type of refrigerant is associated with the unique identifier of the HVAC/Refrigeration system and is stored in the database.

4. The system of claim 1, wherein the processing circuitry is configured to determine and store in the database, at least one of an amount of refrigerant added, an amount of refrigerant removed, or a current refrigerant level of a plurality of different HVAC/Refrigeration systems, wherein the processing circuitry is further configured to obtain a unique identifier of each of the plurality of different HVAC/Refrigeration systems, and store the unique identifier of each of the plurality of different HVAC/Refrigeration systems in the database, wherein the at least one of the amount of refrigerant added, the amount of refrigerant removed, or the current refrigerant level is associated with a unique identifier for an associated HVAC/Refrigeration system.

5. The system of claim 4, wherein the database comprises historical data and a corresponding date of at least one of the amount of refrigerant added, the amount of refrigerant removed, or the current refrigerant level of the plurality of different HVAC/Refrigeration systems, the corresponding date indicating a date of a service operation at which the at least one of the amount of refrigerant added, the amount of refrigerant removed, or the current refrigerant level is determined.

6. The system of claim 5, wherein the processing circuitry is further configured to:

generate a graphical user interface based on data from the database, the graphical user interface illustrating at least one of the amount of refrigerant added, the amount of refrigerant removed, or the current refrigerant level of the plurality of different HVAC/Refrigeration systems, and the unique identifier of each of the plurality of different HVAC/Refrigeration systems; and cause a display to operate to provide the graphical user interface to a technician via a smartphone or to provide the graphical user interface to a system manager via a webpage.

7. The system of claim 1, further comprising a user device comprising processing circuitry and a camera, wherein the user device is configured to capture an image of a data plate of the HVAC/Refrigeration system and at least one of the processing circuitry of the user device or processing circuitry of a cloud computing system is configured to perform an image analysis technique to extract inventory information from the image of the data plate.

8. The system of claim 7, wherein the cloud computing system is configured to store the inventory information extracted from the image in the database, the inventory information comprising a manufacturer of the HVAC/Refrigeration system, a model number of the HVAC/Refrigeration system, a serial number of the HVAC/Refrigeration system, a date that the HVAC/Refrigeration system was manufactured, a type of refrigerant of the HVAC/Refrigeration system, and a factory refrigerant charge level or date of the HVAC/Refrigeration system.

9. A method for tracking refrigerant of a HVAC/Refrigeration system, the method comprising:

obtaining a signal from a sensor of a service tool, the service tool configured to removably couple with a service port of the HVAC/Refrigeration system to define a fluid flow path between a reservoir of the service tool and an inner volume of a tubular member of the HVAC/Refrigeration system, wherein the service tool is configured to add refrigerant to the HVAC/Refrigeration system or remove refrigerant from the HVAC/Refrigeration system;

determining, based on the signal, at least one of an amount of refrigerant added to the HVAC/Refrigeration system or an amount of refrigerant removed from the HVAC/Refrigeration system;

determining, based on at least one of the amount of refrigerant added to the HVAC/Refrigeration system or the amount of refrigerant removed from the HVAC/Refrigeration system, a current refrigerant level in the HVAC/Refrigeration system;

operating a display to provide at least one of the amount of refrigerant added, the amount or refrigerant removed, or the current refrigerant level of the HVAC/Refrigeration system to a user;

obtaining subcooling temperature data of the HVAC/Refrigeration system;

predicting, using machine learning and a root cause database, a leakage event, a predicted time of the leakage event, and a root cause of the leakage event, wherein the leakage event is a reduction of the refrigerant in the HVAC/Refrigeration system, based on (i) the subcooling temperature data and (ii) mechanical health data of at least a compressor of the HVAC/Refrigeration system, the root cause database comprising a plurality of entries of leakage events and subcooling temperature data leading up to the leakage event;

operating the display to notify the user regarding the predicted leakage event and the root cause; and automatically initiating an activity to perform maintenance on the HVAC/Refrigeration system by the predicted time of the leakage event.

10. The method of claim 9, further comprising:

storing at least one of the amount of refrigerant in the HVAC/Refrigeration system, the amount of refrigerant added to the system, or the amount of refrigerant removed from the system in a database.

11. The method of claim 10, further comprising:

obtaining, based on a user input, or based on a captured image, a unique identifier of the HVAC/Refrigeration system, wherein the unique identifier is associated with the amount of refrigerant, the amount of refrigerant added to the HVAC/Refrigeration system, or the amount of refrigerant removed from the HVAC/Refrigeration system and the unique identifier is stored in the database; and providing the unique identifier of the HVAC/Refrigeration system to a cloud computing system with the amount of refrigerant added to the HVAC/Refrigeration system and the amount of refrigerant removed from the HVAC/Refrigeration system.

12. The method of claim 11, further comprising:

obtaining, based on a user input, or based on the captured image, a type of refrigerant that is currently in the HVAC/Refrigeration system, wherein the type of refrigerant is associated with the unique identifier of the HVAC/Refrigeration system and is stored in the database; and providing the type of refrigerant to the cloud computing system with the unique identifier, the amount of refrigerant added to the HVAC/Refrigeration system, and the amount of refrigerant removed from the HVAC/Refrigeration system.

13. The method of claim 9, further comprising:

determining at least one of an amount of refrigerant added, an amount of refrigerant removed, or a current refrigerant level of a plurality of different HVAC/Refrigeration systems;

obtaining a unique identifier of each of the plurality of different HVAC/Refrigeration systems, wherein the at least one of the amount of refrigerant added, the amount of refrigerant removed, or the current refrigerant level is associated with the unique identifier for an associated one of the plurality of different HVAC/Refrigeration systems; and storing at least one of the amount of refrigerant added, the amount of refrigerant removed, or the current refrigerant level of the plurality of different HVAC/Refrigeration systems in a database with a plurality of unique identifiers.

14. The method of claim 13, wherein the database comprises historical data and a corresponding date of at least one of the amount of refrigerant added, the amount of refrigerant removed, or the current refrigerant level of the plurality of different HVAC/Refrigeration systems, the corresponding date indicating a date of a service operation at which the at least one of the amount of refrigerant added, the amount of refrigerant removed, or the current refrigerant level is determined.

15. The method of claim 14, further comprising:

generating a graphical user interface based on data from the database, the graphical user interface illustrating at least one of the amount of refrigerant added, the amount of refrigerant removed, or the current refrigerant level of the plurality of different HVAC/Refrigeration systems, and the unique identifier of each of the plurality of different HVAC/Refrigeration systems; and operating the display by providing the graphical user interface to a technician via a smartphone or providing the graphical user interface to a system manager via a webpage.

16. The method of claim 9, further comprising:

capturing an image of a data plate of the HVAC/Refrigeration system using a user device that includes processing circuitry and a camera;

performing an image analysis technique to extract inventory information of the HVAC/Refrigeration system from the image of the data plate; and storing the inventory information extracted from the image in a database, the inventory information comprising a manufacturer of the HVAC/Refrigeration system, a model number of the HVAC/Refrigeration system, a serial number of the HVAC/Refrigeration system, a date that the HVAC/Refrigeration system was manufactured, a type of refrigerant of the HVAC/Refrigeration system, and a factory refrigerant charge level or date of the HVAC/Refrigeration system.

17. A system for tracking refrigerant and status of a plurality of refrigerated display cases, a plurality of HVAC/Refrigeration units, a plurality of rooftop units, or a plurality of heat pump units, the system comprising:

a plurality of refrigerated units, each refrigerated unit comprising a HVAC/Refrigeration system configured to cool an inner volume of the refrigerated unit;

a user device configured to establish communication with a cloud computing system, the user device configured to communicate with processing circuitry of a service tool to provide data from the service tool regarding an amount of refrigerant added or removed from any of the plurality of refrigerated units;

wherein the cloud computing system is configured to:

obtain a unique identifier indicating which of the plurality of refrigerated units the data from the user device is associated with;

obtain the data from the user device regarding the amount of refrigerant added or removed from a particular one of the plurality of refrigerated units;

store the data regarding the amount of refrigerant added or removed from the particular one of the plurality of refrigerated units in a database associated with the unique identifier, the database comprising the data regarding the amount of refrigerant added or removed from the plurality of refrigerated units for each time a servicing operation is performed at the plurality of refrigerated units;

operate a display to provide an inventory tracking report illustrating an amount of refrigerant present in the plurality of refrigerated units and an amount of refrigerant consumed over a lifetime of at least one of the plurality of refrigerated units based on the database;

obtain subcooling temperature data of one of the HVAC/Refrigeration systems;

predict, using machine learning and a root cause database, a leakage event, a predicted time of the leakage event, and a root cause of the leakage event, wherein the leakage event is a reduction of the refrigerant in the HVAC/Refrigeration system, based on (i) the subcooling temperature data and (ii) mechanical health data of at least a compressor of the HVAC/Refrigeration system, using machine learning and a root cause database, the root cause database comprising a plurality of entries of leakage events and subcooling temperature data leading up to the leakage event;

operate the display to notify the user regarding the predicted leakage event and the root cause; and automatically initiate an activity to perform maintenance on the HVAC/Refrigeration system by the predicted time of the leakage event.

18. The system of claim 17, wherein at least one of the plurality of refrigerated units are refrigerated display cases.

19. The system of claim 17, wherein each of the plurality of refrigerated units comprises a unique identifier, the unique identifier disposed graphically or textually on a surface of the refrigerated unit.

20. The method of claim 9, wherein the root cause database includes root cause data determined by physical inspection and report.

21. The method of claim 9, wherein the root cause database is populated by reports regarding root cause of a failure event or a leakage event.

* * * * *